US008966849B1

(12) United States Patent
Bilge

(10) Patent No.: US 8,966,849 B1
(45) Date of Patent: Mar. 3, 2015

(54) SYSTEM FOR MOUNTING WALL PANELS TO A WALL STRUCTURE

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 0 days.

(21) Appl. No.: 14/547,682

(22) Filed: Nov. 19, 2014

Related U.S. Application Data

(63) Continuation of application No. 14/278,995, filed on May 15, 2014, now Pat. No. 8,925,271.

(51) Int. Cl.

| | |
|---|---|
| ***E04B 2/00*** | (2006.01) |
| ***E04F 13/08*** | (2006.01) |
| ***E04B 1/41*** | (2006.01) |
| ***E04B 2/72*** | (2006.01) |
| ***E04F 13/22*** | (2006.01) |
| ***E04F 13/26*** | (2006.01) |
| *E04B 1/38* | (2006.01) |

(52) U.S. Cl.

CPC ..... *E04F 13/0826* (2013.01); *E04B 1/40* (2013.01); *E04B 2/721* (2013.01); *E04F 13/0864* (2013.01); *E04F 13/22* (2013.01); *E04F 13/26* (2013.01); *E04B 2001/405* (2013.01)

USPC ..... 52/506.05

(58) Field of Classification Search

USPC ..... 52/506.01, 506.05, 506.06, 506.08, 52/508–512

See application file for complete search history.

(56) References Cited

U.S. PATENT DOCUMENTS

| | | | |
|---|---|---|---|
| 1,655,406 | A | 1/1928 | Bennett |
| 1,726,500 | A | 8/1929 | Norris |
| 1,833,174 | A | 11/1931 | Norris |
| 2,059,483 | A | 11/1936 | Parsons |
| 2,066,205 | A | 12/1936 | Keating |
| 2,082,241 | A | 6/1937 | Bennett |
| 2,607,971 | A | 8/1952 | Beford |
| 2,789,321 | A | 4/1957 | Adams |
| 2,803,321 | A | 8/1957 | Fox-Williams |
| 3,021,915 | A | 2/1962 | Kemp |
| 3,671,061 | A | 6/1972 | Dawdy |
| 3,858,377 | A | 1/1975 | Browne et al. |
| 4,332,119 | A | 6/1982 | Toews |
| 4,344,267 | A | 8/1982 | Sukolics |
| 4,452,029 | A | 6/1984 | Sukolics |
| 4,573,300 | A | 3/1986 | Bezner |
| 4,640,064 | A | 2/1987 | Goodworth, II |

(Continued)

FOREIGN PATENT DOCUMENTS

| | | | |
|---|---|---|---|
| DE | 3732534 | A1 | 4/1989 |
| DE | 3732535 | A1 | 4/1989 |

(Continued)

*Primary Examiner* — Mark Wendell
*Assistant Examiner* — Keith Minter
(74) *Attorney, Agent, or Firm* — Richard M. Goldberg

(57) ABSTRACT

A system for mounting wall panels to an existing wall structure, each wall panel including a main wall panel section, bent end sections extending at an angle from edges of the main wall panel section; main fastening extrusions, each including a base, and first and second spaced apart bent end securing walls extending from the base with the spacing therebetween greater than the wall thickness of two bent end sections; a plug member inserted in the spacing between adjacent bent end securing walls and held thereat by either a tape or lower wings; and a recess at a first surface of each bent end section which faces a second surface of a respective bent end securing wall, and a projection at the second surface of each bent end securing wall which is adapted to be received in a respective recess.

12 Claims, 18 Drawing Sheets

(56) References Cited

U.S. PATENT DOCUMENTS

| | | | |
|---|---|---|---|
| 4,667,579 | A | 5/1987 | Daw |
| 4,696,142 | A | 9/1987 | Meiyal et al. |
| 4,829,740 | A | 5/1989 | Hutchison |
| 4,833,839 | A | 5/1989 | Kurose |
| 4,833,858 | A | 5/1989 | Hutchison |
| 5,263,292 | A | 11/1993 | Holland et al. |
| 5,579,624 | A | 12/1996 | Aeberhard |
| 5,644,878 | A | 7/1997 | Wehrmann |
| 5,809,729 | A | 9/1998 | Mitchell |
| 5,996,301 | A | 12/1999 | Conterno |
| 6,101,777 | A | 8/2000 | Bodine et al. |
| 6,164,024 | A | 12/2000 | Konstantin |
| 6,205,733 | B1 | 3/2001 | LaLonde |
| 6,330,772 | B1 | 12/2001 | Mitchell et al. |
| 6,430,885 | B1 | 8/2002 | Ito |
| 6,536,175 | B2 | 3/2003 | Conterno |
| 6,745,527 | B1 | 6/2004 | Sherman et al. |
| 6,751,916 | B1 | 6/2004 | Ritzer et al. |
| 6,892,500 | B2 | 5/2005 | Zabrowski |
| 7,210,273 | B2 | 5/2007 | Zahner, III |
| 7,472,521 | B2 | 1/2009 | Bilge |
| 7,621,084 | B2 | 11/2009 | Bilge |
| 7,752,818 | B1 | 7/2010 | Roegge et al. |
| 8,127,507 | B1 | 3/2012 | Bilge |
| 8,166,716 | B2 | 5/2012 | Macdonald et al. |
| 8,225,572 | B2 | 7/2012 | Wallace |
| 8,256,181 | B2 | 9/2012 | Voegele, Jr. et al. |
| 8,307,607 | B2 | 11/2012 | Conterno |
| 8,316,609 | B2 | 11/2012 | Ben-Zvi |
| 8,347,569 | B1 | 1/2013 | McIntyre et al. |
| 8,640,402 | B1 | 2/2014 | Bilge |
| 8,739,483 | B1 | 6/2014 | Bilge |
| 8,833,015 | B2 | 9/2014 | Bilge |
| 2001/0022058 | A1 | 9/2001 | Conterno |
| 2002/0035811 | A1 | 3/2002 | Heuel |
| 2002/0152704 | A1 | 10/2002 | Thompson et al. |
| 2004/0134143 | A1 | 7/2004 | Boyer |
| 2009/0049770 | A1 | 2/2009 | Konstantin |
| 2009/0241444 | A1 | 10/2009 | Griffiths |
| 2009/0241451 | A1 | 10/2009 | Griffiths |
| 2014/0202112 | A1 | 7/2014 | Bilge |
| 2014/0202113 | A1 | 7/2014 | Bilge |
| 2014/0223850 | A1 | 8/2014 | Bilge |

FOREIGN PATENT DOCUMENTS

| | | | |
|---|---|---|---|
| EP | 2166169 | A1 | 3/2010 |
| GB | 2135355 | A | 8/1984 |
| JP | 8-189176 | A | 7/1997 |

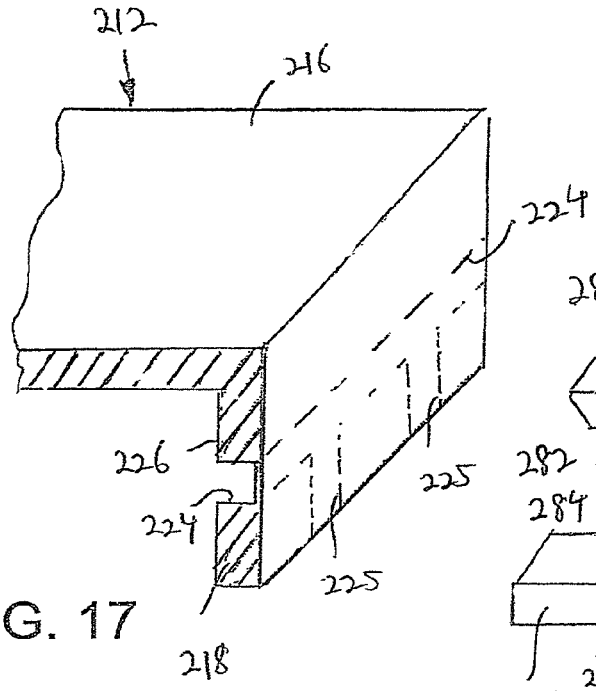
FIG. 17
FIG. 18
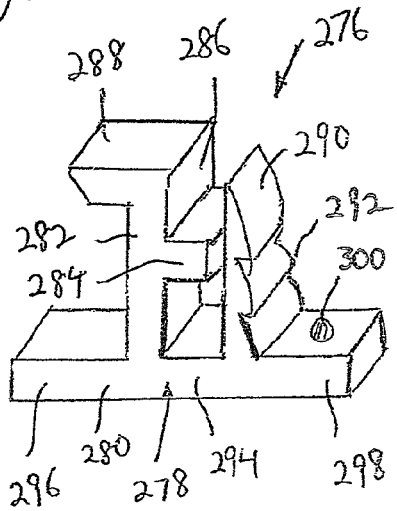
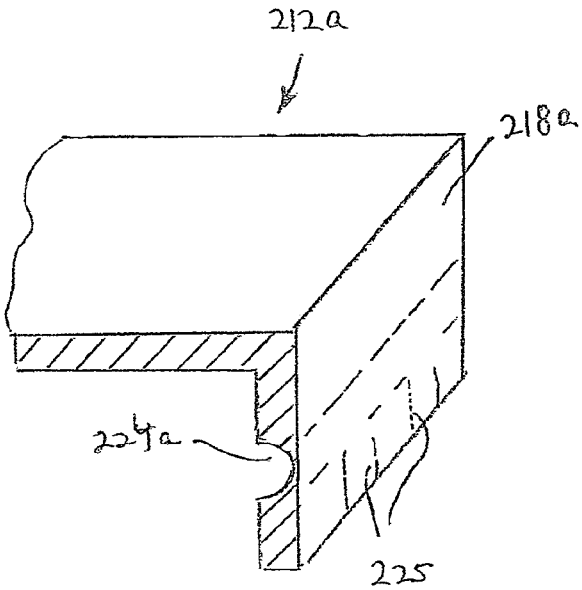
FIG. 19
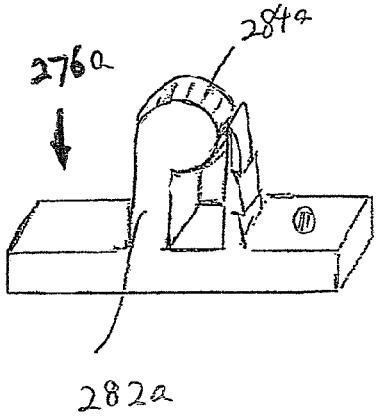
FIG. 20

SYSTEM FOR MOUNTING WALL PANELS TO A WALL STRUCTURE

BACKGROUND OF THE INVENTION

The present invention relates generally to a wall system, and more particularly, to a system for easily mounting wall panels over an existing wall structure.

In order to enhance the look of a wall structure, it is known to secure decorative wall panels to the wall structure. However, the securement of wall panels to the wall structure is generally a long and tedious job since it entails using fastening devices such as nails and/or screws to secure the walls panels directly to the wall structure. In addition, the fastening devices are exposed, which can provide an unsightly appearance.

A system that overcomes some of these problems is sold by Bamco Inc. of 30 Baekeland Ave., Middlesex, N.J. 08846 under the designation "G500 WALL SYSTEM." With this system, the wall panels are provided with right angle or bends at their edges. Each planar panel and the right angle bend together form an L-shape. Each bend is secured by screws to a fastening extrusion having the same linear dimension as the wall panel, and the fastening extrusion has a generally rectangular cross-sectional configuration. At each joint area where two panels meet, there are two such fastening extrusions connected together, each secured to a respective wall panel, with an elongated hard silicone gasket between the fastening extrusions. The fastening extrusions are arranged one above the other at each joint area. Thus, the screws are not visible, thereby eliminating the unsightly appearance of previous system.

However, because of the L-shape at the bends at the edges of the wall panels, it is necessary to separately secure each bend to a fastening extrusion by screws, in addition to securing the fastening extrusions to the wall structure by screws, further increasing the work required to assemble the wall panels. Also, because the bends in the wall panels extend only in a direction perpendicular to the wall panels, the only structural support is provided by the screws which secure each bend to a fastening extrusion. As a result, it is possible to loosen and/or pull out the wall panels.

In addition, in order to secure the fastening extrusions to existing wall structures, one of the connected pair of fastening extrusions is provided with an extension which is separately secured to the existing wall structure. This means that the main bodies of the fastening extrusions are spaced away from the existing wall structure, thereby providing a further weak link in the structure, besides making it more difficult to assemble.

U.S. Pat. No. 7,472,521 and U.S. Pat. No. 7,621,084, by the same inventor herein disclose systems for mounting wall panels to an existing wall structure, which includes a plurality of wall panels. There are also a plurality of fastening extrusions. Each fastening extrusion includes a securing section for securing the fastening extrusion to the existing wall structure, and a retaining wall structure at one end of the securing section, the retaining wall structure including a recess which receives one hook wall of the wall panel.

The main panel section has a rectangular configuration with four hook walls, and there are four fastening extrusions, with the recess of the retaining wall of each fastening extrusion receiving one hook wall of the wall panel. Each U-shaped cross-sectional profile defines a recess therein, and each fastening extrusion includes at least one stabilizing wall extending from a free end of a respective retaining wall, with the stabilizing wall being received in one recess of a respective U-shaped cross-sectional profile. Each stabilizing wall has an L-shaped cross-sectional profile. Also, the securing section and the retaining wall structure together define a U-shaped cross-sectional profile.

A first one of the fastening extrusions includes a tongue and a second one of the fastening extrusions includes a groove for receiving the tongue to connect together the first and second fastening extrusions when the first fastening extrusion is assembled with a first wall panel and the second fastening extrusion is assembled with a second wall panel. In a later embodiment, there is only a single fastening extrusion.

There is also at least one channel secured to the securing sections of adjacent fastening extrusions and positioned between adjacent wall panels corresponding thereto. An elongated plug is inserted into each channel for closing off the gap between adjacent wall panels.

This arrangement, however, requires the insertion of screws into the fastening extrusions and the channel while supporting the wall panels, which can be burdensome. It also requires the separate channels and plugs in order to close off the gap between adjacent wall panels to provide an aesthetic appearance between the wall panels. If the gap between adjacent panels is varied, this would also require a plurality of different size plugs, which can further add to the cost of the structure.

A further system has been sold for more than one year by Creative Metal Contractors Inc. of Toms River, New Jersey, which uses a single fastening extrusion having tongues extending from opposite sides thereof. The single fastening extrusion is secured to the existing wall by screws at a central portion thereof between the tongues. Each wall panel has a main panel section and hook walls at edges of the main panel section, with the main panel section and each hook wall having a U-shaped cross-sectional profile. Fasteners or frame extrusions are secured to the hook walls, with each fastener including walls defining a recess which receives a corresponding tongue of the single fastening extrusion, such that the tongues are spaced away from the hook walls. A compressed joint plug is positioned in overlying relation to the screws and between adjacent hook walls to provide an aesthetic appearance.

However, with this latter arrangement, plugs are also required, with the same consequent disadvantages. It may also be difficult to align the recesses over the tongues of the single fastening extrusion. In addition, the single fastening extrusions are secured to the existing wall by screws only through the center of the fastening extrusions, which can result in failure of such securement. Still further, if the gap between adjacent panels is varied, this would also require a plurality of different size plugs, which can further add to the cost of the structure.

The invention of U.S. Pat. No. 8,127,507 to the same inventor herein also requires the insertion of screws into the fastening extrusions and the channel while supporting the wall panels, which can be burdensome. It also requires the separate decorated panels in order to close off the gap between adjacent wall panels to provide an aesthetic appearance between the wall panels.

U.S. patent application Ser. No. 12/652,879, to the same inventor herein, attempts to cure the aforementioned problems, by providing a wall system which does not require the use of screws to secure the wall panels to the fastening extrusions. Rather, the wall panels have recesses into which the frame extrusions fit, and which also eliminates the use of plugs to cover the gap between adjacent wall panels. This permits easy hanging of the wall panels by providing a male connecting frame extrusion that merely fits within a female connecting wall panel.

It is also known from U.S. Pat. No. 4,344,267 to Sukolics, U.S. Pat. No. 4,829,740 to Hutchison and U.S. Pat. No. 5,809,729 to Mitchell, to provide a wall system with L-shaped ends of the panels that include recesses in the bent ends that engage with projections of the extrusions secured by screws to the walls. However, with these patents, there is still a large gap between adjacent bent ends, which is necessary for securing the panels to the extrusions, and which also thereby requires a plug to close this gap.

With all of the above arrangements, it can become difficult to assemble the wall panels with the extrusions, while also ensuring that the extrusions are accurately secured to the wall.

SUMMARY OF THE INVENTION

Accordingly, it is an object of the present invention to provide a wall system that overcomes the aforementioned problems.

It is another object of the present invention to provide a wall system in which the wall panels and extrusions are connected together prior to fastening the extrusions to the existing wall.

It is a still further object of the present invention to provide a wall system that is easy to assemble with an existing wall structure.

It is a yet further object of the present invention to provide a wall system that is easy and economical to manufacture and use.

In accordance with an aspect of the present invention, a system for mounting wall panels to an existing wall structure, includes a plurality of wall panels, each wall panel including a main wall panel section, and at least two bent end sections extending at an angle from different edges of the main wall panel section, each bent end section having a wall thickness. A plurality of main fastening extrusions are provided, each main fastening extrusion including a base section adapted to be secured to the existing wall structure, and first and second spaced apart bent end securing walls extending at an angle from the base section, the two bent end securing walls having a spacing therebetween greater than the wall thickness of two bent end sections. A plug member is inserted in the spacing between adjacent bent end securing walls for preventing escape of the adjacent bent end securing walls from the spacing, the plug member held in the spacing by a tape at a lower end of the plug member that secures the plug member to the base section, or at least one wing extending outwardly from a lower end of the plug member and which extends beneath a distal lower end of a respective bent end section.

In one embodiment, a recess is provided at a first surface of each bent end section which faces a second surface of a respective bent end securing wall, and a projection at the second surface of each bent end securing wall which is adapted to be received in a respective recess. Alternatively, a recess is provided at the second surface of each bent end securing wall, and a projection at the first surface of each bent end section which is adapted to be received in a respective recess at the second surface.

Each projection has a cross-sectional shape of a square shape, a rectangular shape, a triangular shape, a triangular shape with a rounded upper surface, a trapezoidal shape, or a cylindrical shape.

Preferably, each recess is formed in the first surface of each bent end section, and each projection is formed at the second surface of each bent end securing wall.

Preferably, the plug member includes two wings extending outwardly in opposite directions from a lower end of the plug member and which extend beneath a distal lower end of respective adjacent bent end sections in the spacing.

In accordance with another aspect of the present invention, a system for mounting wall panels to an existing wall structure, includes a plurality of wall panels, each wall panel including a main wall panel section, and at least two bent end sections extending at an angle from different edges of the main wall panel section, each bent end section having a wall thickness. There are a plurality of main fastening extrusions, each main fastening extrusion including a base section adapted to be secured to the existing wall structure, and first and second spaced apart bent end securing walls extending at an angle from the base section, the two bent end securing walls having a spacing therebetween greater than the wall thickness of two bent end sections.

In one embodiment, a recess is provided at a first surface of each bent end section which faces a second surface of a respective bent end securing wall, and a projection at the second surface of each bent end securing wall which is adapted to be received in a respective recess. Alternatively, a recess is provided at the second surface of each bent end securing wall, and a projection at the first surface of each bent end section which is adapted to be received in a respective recess at the second surface.

Each recess and projection form a dovetail joint, with each projection engaged in a respective recess by sliding transversely therein. Thus, each projection and each recess has a trapezoidal cross-sectional shape.

Further, an extra gap can be provided between the base section of each main fastening extrusion and distal lower ends of bent end sections, and a plate member provided in the gap for closing off the gap and providing an aesthetic appearance.

In accordance with still another aspect of the present invention, a system for mounting wall panels to an existing wall structure, includes a plurality of wall panels, each wall panel including a main wall panel section, and at least two bent end sections extending at an angle from different edges of the main wall panel section, each bent end section having a wall thickness. There are a plurality of main fastening extrusions, each main fastening extrusion including a base section adapted to be secured to the existing wall structure, and first and second spaced apart bent end securing walls extending at an angle from the base section, the two bent end securing walls having a spacing therebetween substantially equal to the wall thickness of one the bent end section In one embodiment, a recess is provided at a first surface of each bent end section which faces a second surface of a respective bent end securing wall, and a projection at the second surface of each bent end securing wall which is adapted to be received in a respective recess. Alternatively, a recess is provided at the second surface of each bent end securing wall, and a projection at the first surface of each bent end section which is adapted to be received in a respective recess at the second surface.

In this aspect, each projection has an upper surface with a shape of an inclined surface, or a curved convex surface. Further, each recess has a corresponding to the shape of the respective projection received therein, or a rectangular cross-sectional shape.

In accordance with still another aspect of the present invention, a system for mounting wall panels to an existing wall structure, includes a plurality of wall panels, each wall panel including a main wall panel section, and at least two bent end sections extending at an angle from different edges of the main wall panel section, each bent end section having a wall thickness. There are a plurality of main fastening extrusions, each main fastening extrusion including a first main fastening extrusion section and a second main fastening extrusion section. The first main fastening extrusion section includes a first base section adapted to be secured to the existing wall structure, a first bent end securing wall extending at an angle from the first base section, and an L-shaped extension. The L-shaped extension includes a first leg as a lateral connecting wall that extends inwardly from a lower portion of the first bent end securing wall at a position spaced above and parallel to the first base wall so as to form a space therebetween, and a second leg as a first inner wall that extends from a free end of first leg in parallel spaced apart relation to the first bent end securing wall with a spacing substantially equal to the wall thickness of one bent end section which fits therein. The second main fastening extrusion section includes a second base section adapted to be positioned within the space between the first leg and the first base wall, a second bent end securing wall extending at an angle from the second base section, and a second inner wall that extends from the second base section in parallel spaced apart relation to the second bent end securing wall with a spacing substantially equal to the wall thickness of one bent end section which fits therein.

In one embodiment, a recess is provided at a first surface of each bent end section which faces a second surface of a respective bent end securing wall, and a projection at the second surface of each bent end securing wall which is adapted to be received in a respective recess. Alternatively, a recess is provided at the second surface of each bent end securing wall, and a projection at the first surface of each bent end section which is adapted to be received in a respective recess at the second surface.

Further, there is a spacing between the first and second inner walls, and surfaces of the first and second inner walls that face each other have barbs thereon for receiving a plug.

The above and other features of the invention will become readily apparent from the following detailed description thereof which is to be read in connection with the accompanying drawings.

BRIEF DESCRIPTION OF THE DRAWINGS

FIG. 17 is a perspective view, partly in section, of the wall panel of FIG. 14;

FIG. 18 is a perspective view of a fastening extrusion segment for use with the wall panel of FIG. 14;

FIG. 19 is a perspective view, partly in section, of a modification of the wall panel of FIG. 14;

FIG. 20 is a perspective view of a modified fastening extrusion segment for use with the wall panel of FIG. 19;

DETAILED DESCRIPTION

Figure 2:
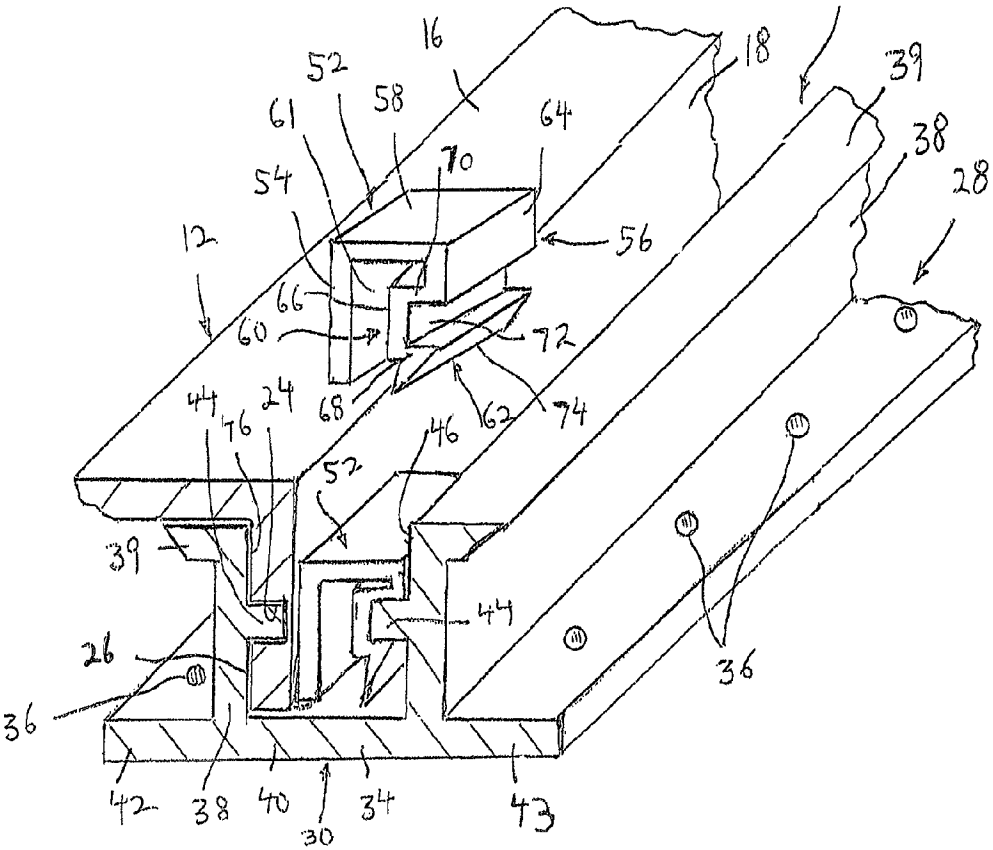
FIG. 2 is a perspective view, partly in section, of a main fastening extrusion having a wall panel secured thereto by plugs, according to the present invention.
Figure 3:
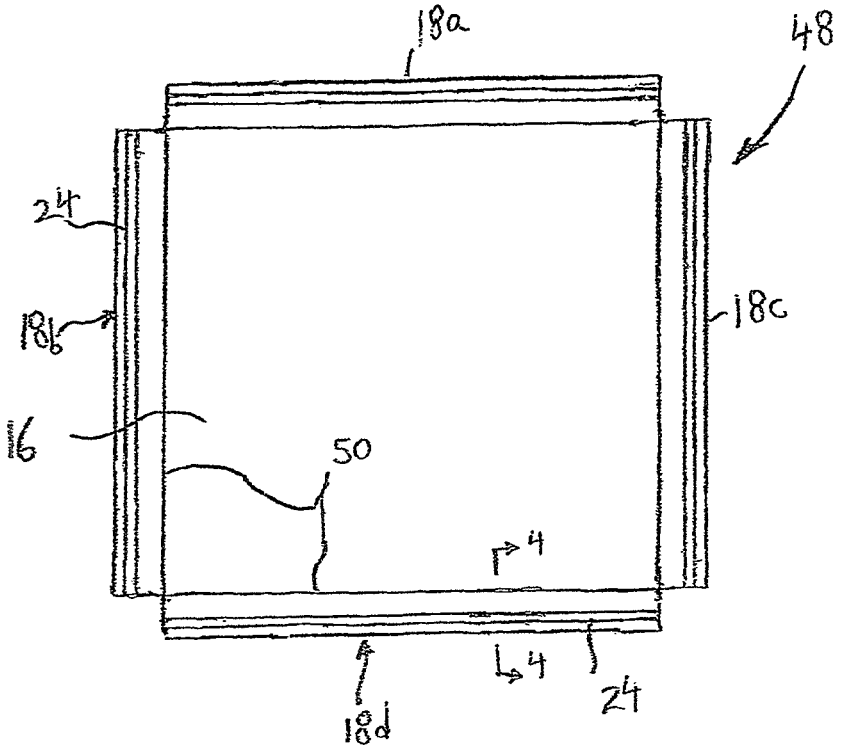
FIG. 3 is a bottom plan view of a blank for forming the wall panel of FIG. 2.
Figure 4:
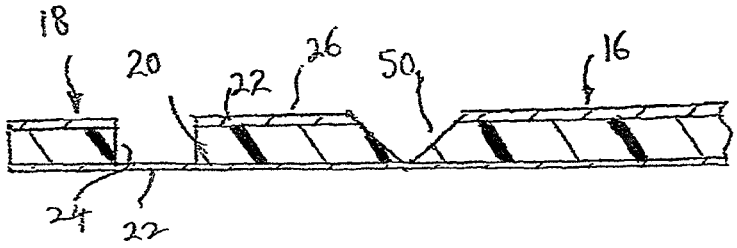
FIG. 4 is a cross-sectional view of the blank of FIG. 3, taken along lie 4-4 thereof.

Referring to the drawings in detail, and initially to FIGS. 1-5 thereof, there is shown a system 10 according to the present invention for easily mounting wall panels 12 over an existing wall structure 14. Wall structure 14 preferably includes any planar wall. Each panel 12 includes a rectangular shaped, planar main panel section 16 and at least two bent end sections 18 bent at a right angle in the same direction at edges of main panel section 16. Main panel 16, however, need not be planar, and in fact, can have different shapes, such as a wave shape, etc. to provide different aesthetic appearances. Preferably, there are four bent end sections 18 at each edge of main panel section 16 which form an L-shaped cross-sectional shape thereat. However, the invention is not limited thereby and wall panels 12 can be formed with two, three or four bent end sections 18. Wall panels 12 are formed preferably by, but not limited to, a polyethylene core 20 with a thin aluminum wall 22 covering opposite sides thereof, as shown in FIG. 4. However, for the sake of simplicity in the drawings, all of the drawings except for FIG. 4 show wall panels 12 formed of only a single material.

In addition, each bent end section 18 includes a cut-out recess 24 at the inner surface 26 thereof, spaced slightly away from main panel section 16 and extending in the lengthwise direction thereof parallel to main panel section 16. Each cut-out recess 24 preferably has a square or rectangular configuration in cross-section, although the present invention is not limited thereby. As a result, cut-out recess 24 effectively forms a notch in the inner surface 26 of bent end section 18. Cut-out recess 24 preferably extends along the entire length of the bent end section 18, although the present invention is not so limited, that is, cut-out recess 24 can extend along only a part of the length of bent end section 18, or there may be a plurality of spaced apart cut-out recess 24.

As shown in FIG. 2, main fastening extrusions 28 are provided for securing each wall panel 12 to existing wall structure 14. Each main fastening extrusion 28 is preferably formed as a single, one-piece, unitary member that includes a base section 30 secured to existing wall structure 14 and a supporting section 32 that connects to a side edge of each panel 12. As with each panel 12, each main fastening extrusion 28 is formed preferably by, but not limited to, a polyethylene core 20 with a thin aluminum wall 22 covering opposite sides thereof. Alternatively, each main fastening extrusion 12 can be formed from polyvinyl chloride (PVC), aluminum or any other suitable material.

Base section 30 includes a central planar wall 34 that seats flush against existing wall structure 14, and which has a plurality of linearly aligned openings 36 extending therealong and through which screws (not shown) can be inserted to secure central wall panel 34 to existing wall structure 14. Two, parallel, spaced apart, bent end securing walls 38 extend outwardly at right angles from central planar wall 34 for securing bent end sections 18 of two adjacent wall panels 12 thereto, with the distance between bent end securing walls 38 being greater than the thickness of two bent end sections 18. Bent end securing walls 38 are spaced inwardly from edges of central planar wall 34 so as to divide central planar wall 34 into a central section 40 between bent end securing walls 38, and two wing sections 42 and 43 to the outside of bent end securing walls 38. Openings 36 are provided along wing sections 42 and 43. Openings (not shown) can also be provided along central section 40.

Each bent end securing wall 38 includes an inwardly directed projection 44 at the inner surface 46 of the respective bent end securing wall 38, with each projection 44 having a square or rectangular configuration in cross-section, which corresponds in shape and dimensions to square or rectangular cut-out recess 24, although the present invention is not limited thereby. For example, each cut-out recess 24 and projection 44 can have a triangular nose-shape in cross-section as shown in applicant's copending U.S. patent application Ser. No. 13/868,574, the entire disclosure of which is incorporated herein by reference, or any other suitable configuration. Projection 44 preferably extends along the entire length of the bent end securing wall 38, although the present invention is not so limited, that is, projection 44 can extend along only a part of the length of bent end securing wall 38, or there may be a plurality of spaced apart projections 44. However, in such case, cut-out recesses 24 would be likewise configured.

The upper free end of each bent end securing wall 38 includes an outwardly extending stub wall 39 that is perpendicular to the respective bent end securing wall 38 and parallel to and immediately adjacent to or abutting with main panel section 16 when assembled with wall panel 12.

As shown in FIG. 3, each wall panel 12 is preferably formed from a planar blank 48, which can be stamped from or cut from a larger sheet of the respective material. Specifically, each planar blank 48 is formed by planar main panel section 16 which is preferably, but not limited to, a square shape with all sides being equal. There are four bent end sections 18, each formed as one unitary piece at a respective side edge of planar main panel section 16, and coplanar therewith. A V-shaped cut-out 50 extends through one thin aluminum wall 22 and polyethylene core 20 at the connecting edge of each bend end section 18 to the side edge of planar main panel section 16, as best shown in FIG. 4. This permits each bent end section 18 to be bent along its respective V-shaped cut-out 50 at a right angle to planar main panel section 16 in the manner shown, for example, in FIG. 2. Each bent end section 18 further includes cut-out recess 24 at the inner surface 26 thereof and spaced slightly away from main panel section 16. For ease of explanation hereafter, and for conformity, reference will be made to a top bent end section 18*a*, a left side bent end section 18*b*, a right side bent end section 18*c* and a bottom bent end section 18*d*, although this is only for explanation purposes and does not limit the invention.

As discussed above, in practice, it can be difficult to assemble extrusions 28 to an existing wall structure while also holding wall panels 12.

Therefore, in accordance with the present invention, as shown in FIG. 2, snap-in clips or plugs 52 are removably provided for temporarily securing wall panels 12 to main fastening extrusions 38, in order to provide ease of assembly. Snap-in plugs 52 are of a much small length than bent sections 18 of wall panels 12, and for example, may be approximately 2 cm long. Also, snap-in plugs 52 are made of a flexible, resilient material, preferably plastic, but not limited thereto. For example, plugs 52 can be made of any suitable material, such as a metal, a composite or the like.

Specifically, each snap-in plug 52 includes a holding wall 54 of a generally square or rectangular configuration, a biasing wall 56 and a connecting wall 58 which connects together holding wall 54 and biasing wall 56 in generally parallel, spaced apart relation. Biasing wall 56 includes a U-shaped projection engaging wall section 60 for receiving a projection 44 of a bent end securing wall 38, an entry engaging wall section 62 connected to a distal end of projection engaging wall section 60, and a connecting wall section 64 connected to the opposite end of projection engaging wall section 60. A gap 61 is defined between holding wall 54 and biasing wall 56. U-shaped projection engaging wall section 60 includes a central leg wall section 66 in parallel, spaced relation to biasing wall 56 and two outer leg wall sections 68 and 70 extending outwardly at right angles in the same direction from opposite edges of central leg wall section 66 so as to define a recess 72 for receiving a projection 44. Entry engaging wall section 62 is connected to the free end of outer leg wall section 68. Entry engaging wall section 62 has a beveled or inclined surface 74 at the outer facing surface thereof. Connecting wall section 64 is connected in parallel, spaced relation to holding wall 54 and has opposite ends thereof connected to the free end of outer leg wall section 70 and one edge of connecting wall 58, respectively. The opposite edge of connecting wall 58 is connected with one edge of holding wall 54, such that holding wall 54, connecting wall 58 and biasing wall 56 effectively have a U-shaped configuration, which is perpendicular to the U-shaped configuration of U-shaped projection engaging wall section 60.

With this arrangement, a wall panel 12 can be temporarily secured to a bent end securing wall 38. Specifically, as shown in FIG. 2, wall panel 12 is assembled with bent end securing wall 38 such that cut-out recess 24 receives projection 44 and the respective surfaces of bent end section 18 and bent end securing wall 38 are in abutting, or near abutting, relation, that is in juxtaposition next to each other. Then, plugs 52 are inserted in the gap between the assembled bent end section 18 and the other bent end securing wall 38. To accomplish this, plug 52 are merely pressed down into this gap, such that beveled surface 74 of biasing wall 56 engages with and rides along the upper free edge of the projection 44 of the other bent end securing wall 38, which causes biasing wall 56 to be biased in a direction toward holding wall 54 until plug 52 is pressed sufficiently into this gap that the projection 44 of the other bent end securing wall 38 engages in recess 72. Since biasing wall 56 is no longer constrained, and due to the resilient nature thereof, biasing wall 56 returns to its original position shown in FIG. 2, whereupon the projection 44 seats entirely in recess 72, thereby locking plug 52 in the gap. In this position, the outer face of holding wall 54 presses against the outer face of bent end section 18 to hold it in place and prevent escape thereof. This operation is repeated for a plurality of plugs 52. In order to later remove plugs 52, each plug can be pulled up with holding wall 54 being pulled up first, thereby angling the plug and releasing projection 44 from recess 72. This can be accomplished by hand, or if necessary, by a simple tool, such as a screwdriver shaft inserted into gap 61.

Alternatively, plugs 52 can be slid into the same engagement from the side.

It will be appreciated that this operation can be performed in the shop so that this assembly of wall panel 12, extrusion 28 and plugs 52 can be assembled as a unitary assembly to the job site. This operation is preferably performed in the shop for three sides of wall panel 12, that is, with respect to three bent end sections 18 of a wall panel 12 that have been turned at right angles to main panel section 16 about V-shaped cut-outs 50, with the fourth bent end section 18 remaining coplanar with main panel section 16, the reason for which will be understood from the description hereafter. This can occur with the three bent end securing walls by bending bent end sections 18 at right angles to main wall panel 16 and then securing a main fastening extrusion 28 to each bent end section 18 by plugs 52. Alternatively, with bent end sections 18 coplanar to main wall panel 16, prior to bending thereof, a main fastening extrusion 28 can be secured to each bent end section 18 by plugs 52, with bent end sections 18 then being bent at right angles to main panel section 16. In the latter arrangement, as will be understood from the description hereafter, main fastening extrusions 28 can be slide along bent end sections 18 prior to bending thereof. This is advantageous where the profiles of cut-out recesses 24 and projections only allow for this type of assembly.

When assembling the main fastening extrusion 28 with the fourth bent end section 18, it may be necessary to assembly main fastening extrusion 28 with the fourth bent end section 18 while this bent end section 18 is coplanar with main wall panel 16, and then to bend this bent end section 18 at right angles to main wall panel 16.

Figure 2A:
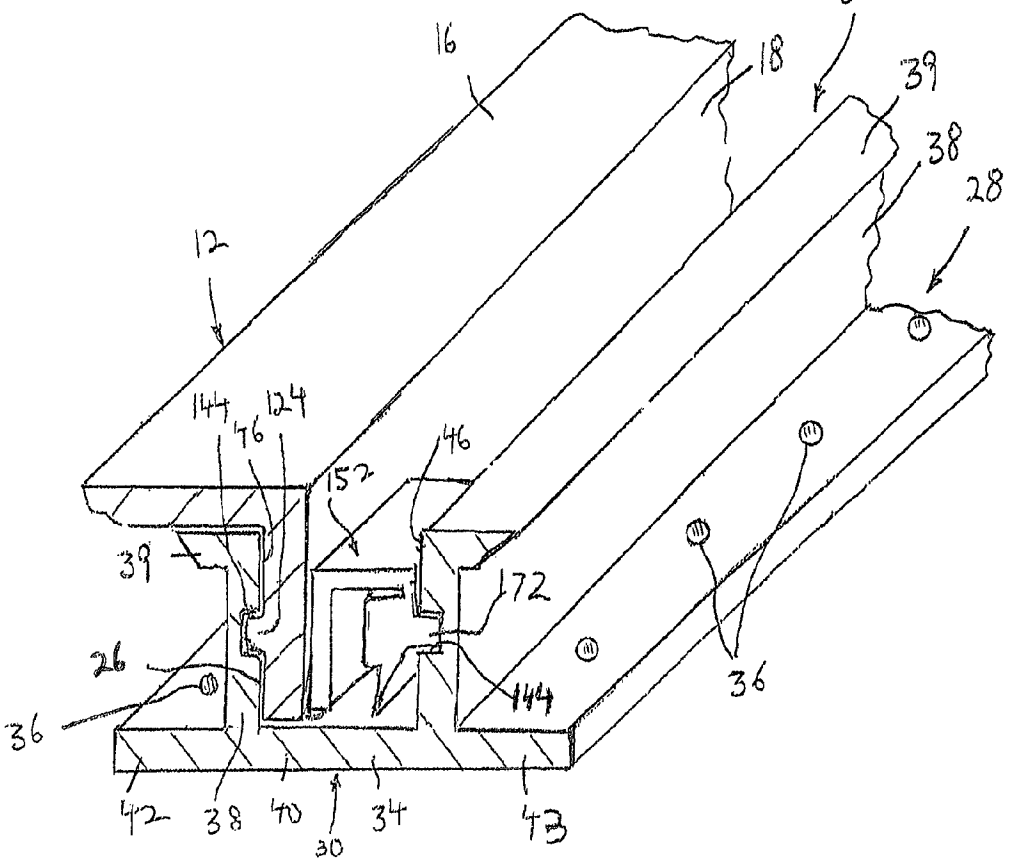
FIG. 2A is a perspective view, partly in section, of a modified main fastening extrusion having a modified wall panel secured thereto by modified plugs, according to the present invention.

It will be appreciated that, while recesses 24 and recesses 72 have been shown in bent end sections 18 and plugs 52, respectively, and projections 44 have been shown at bent end securing walls 38, the reverse may be true, as shown in FIG. 2A, in which recesses 24 and 72 in bent end sections 18 and plugs 52 have been replaced with projections 124 and 172, and projections 44 at bent end securing walls 38 have been replaced with recesses 144. In such case, plugs 152 are required to be slid into position from the side.

Figure 5:
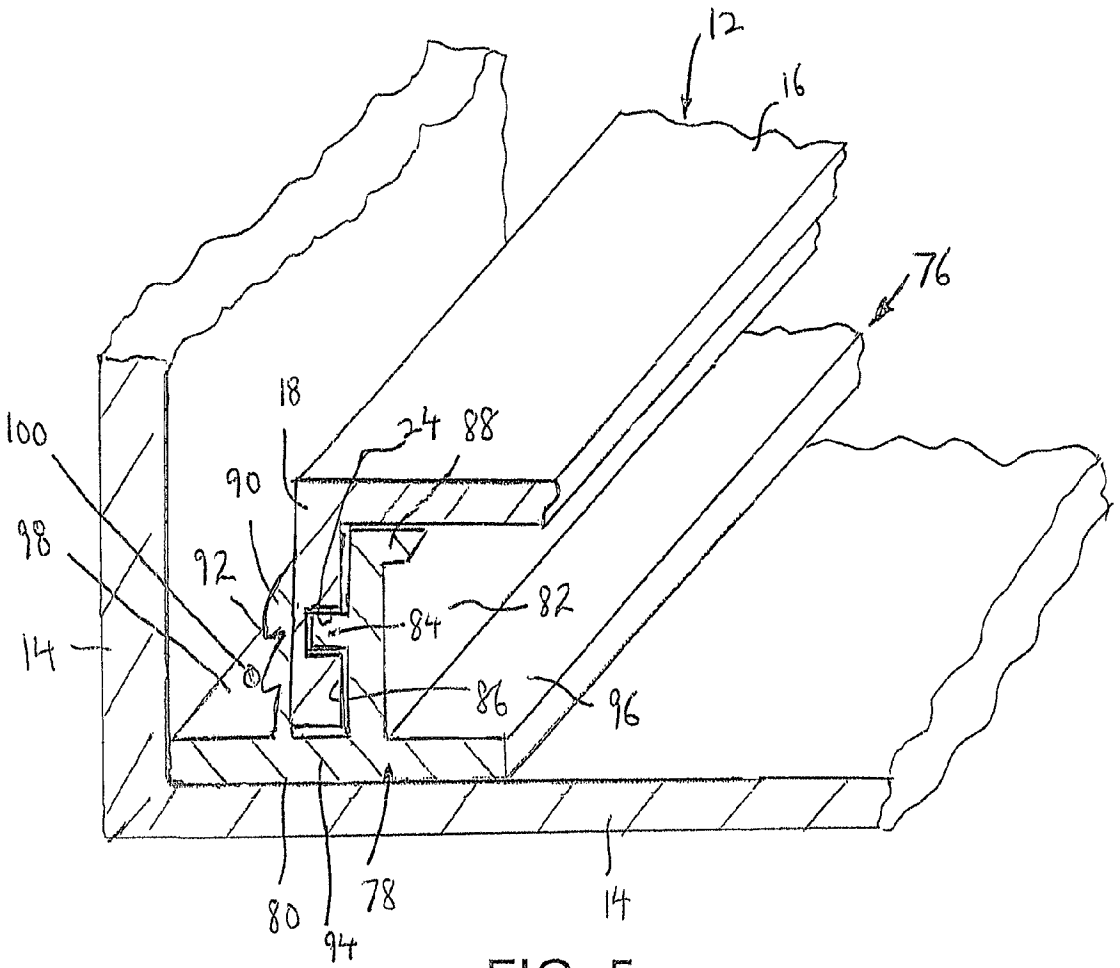
FIG. 5 is a perspective view, partly in section, of a first corner fastening extrusion having a wall panel secured thereto, according to the present invention.

In order to start a wall at a corner of existing wall structure 14, as shown in FIG. 5, left side corner fastening extrusions 76 are provided. Each corner fastening extrusion 76 includes a base section 78 formed by a planar wall 80 that lies flush against an existing wall 14. A first bent end securing wall 82 extends outwardly at a right angle from planar wall 80 for securing a bent end section 18 of a wall panel 12 thereto. Bent end securing wall 82 includes a projection 84 at the inner surface 86 thereof, with projection 84 having a parallelepiped configuration, that is, a square or rectangular configuration in cross-section, which corresponds in shape and dimensions to square or rectangular cut-out recess 24, although the present invention is not limited thereby. For example, each cut-out recess 24 and projection 84 can have a nose-shape in cross-section as shown in applicant's copending U.S. patent application Ser. No. 13/868,574, the entire disclosure of which is incorporated herein by reference, or any other suitable configuration. Projection 84 preferably extends along the entire length of the bent end securing wall 82, although the present invention is not so limited, that is, projection 84 can extend along only a part of the length of bent end securing wall 82, or there may be a plurality of spaced apart projections 84. However, in such case, cut-out recesses 24 would be likewise configured. Further, recess 24 and projection 84 can be reversed in the same manner as shown in FIG. 2A.

The upper free end of bent end securing wall 82 includes an outwardly extending stub wall 88 that is perpendicular to the respective bent end securing wall 82 and parallel to and immediately adjacent to or abutting with main panel section 16 when assembled with wall panel 12.

A second bent end securing wall 90 extends outwardly from planar wall 80 in parallel, spaced apart relation to bent end securing wall 82, with the spacing between bent end securing walls 82 and 90 being substantially equal to the thickness of one bent end section 18. Projection 84 faces in a direction toward bent end securing wall 90 as to be positioned in the gap between bent end securing wall 82 and second wall 90. The opposite side of bent end securing wall 90 is provided with barbs 92 that are angled toward planar wall 80. Planar wall 80 is thereby divided into a central section 94 between bent end securing walls 82 and 90, and two wing sections 96 and 98 to the outside of bent end securing wall 82 and bent end securing wall 90, respectively, with wing section 98 having a plurality of linearly aligned openings 100 extending thereal-ong and through which screws (not shown) can be inserted to secure planar wall 80 to existing wall structure 14.

For mounting wall panels 12, a left side bent end section 18*b* of a first wall panel 12 is slid into the gap between bent end securing walls 82 and 90 of a corner fastening extrusion 76, with projection 84 received in cut-out recess 24 of the first wall panel 12. This can be performed after bent end section 18*b* is bent at a right angle, or alternatively, before bent end section 18*b* is bent at a right angle to main panel section 16 and then bent with respect thereto. In like manner, a corner fastening extrusion 76 is assembled with top bent end section 18*a*.

Then, a main fastening extrusion 28 is assembled with right side bent end section 18*c* of the first wall panel 12, and a main fastening extrusion 28 is assembled with bottom side bent end section 18*d* of the first wall panel 12 in the same manner. This can be performed after bent end sections 18*c* and 18*d* are bent at right angles, or alternatively, before bent end sections 18*a* are bent at right angles to main panel section 16 and then bent with respect thereto. However, in accordance with the present invention, because of the larger gap between bent end securing walls 38 of this main fastening extrusion 28, plugs 52 are pressed down into this gap for each main fastening extrusion 28 in order to hold bent end sections 18*c* and 18*d* thereto.

It will be appreciated that, because bottom bent end section 18*d* is already bent at a right angle to main panel section 16, bent end section 18*b* cannot slide out from corner fastening extrusion 76.

It will be appreciated that, in place of main fastening extrusion 28, a plurality of spaced apart main fastening extrusions of a shorter length can be provided. The same applies to corner fastening extrusions 76.

Figure 1:
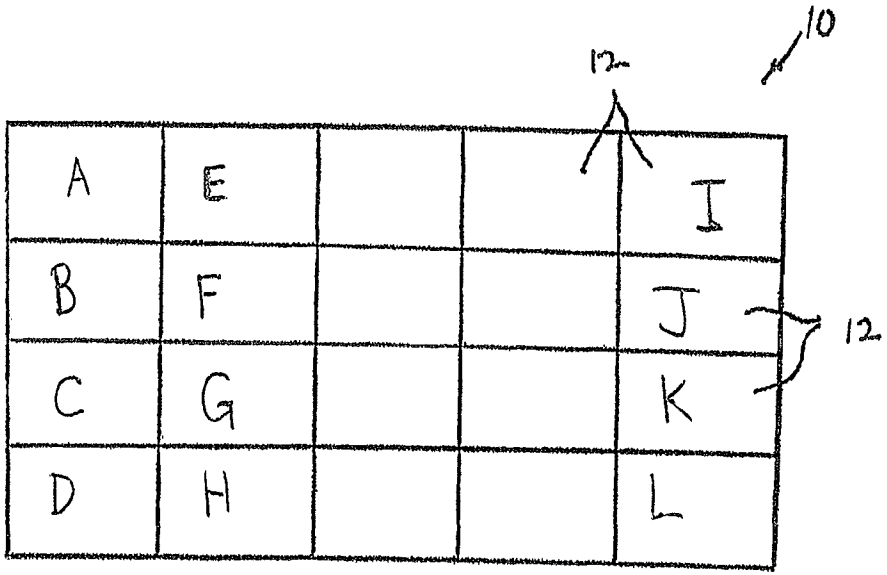
FIG. 1 is an elevational view of a plurality of wall panels mounted to an existing wall structure.

When brought to a job site, and assuming that the first panel 12 is to be secured at position A in FIG. 1, where there is a top wall 14 corresponding to bent end section 18*a*, it is only necessary to first secure corner fastening extrusions 76 assembled with top bent end section 18*a* and left side bent end section 18*b* at position A in FIG. 1 by screws (not shown) inserted into openings 100. Because main fastening extrusions 28 are held by plugs 52 to bent end sections 18*c* and 18*d*, they need not be separately held during installation. Screws (not shown) secure these main fastening extrusions 28 to the existing wall through openings 36 in wing sections 43 and/or central section 40. There is thus no need to hold main fastening extrusions 28 in place. Alternatively and/or in addition thereto, openings 36 can be provided in central section 40 to secure main fastening extrusions 28 to the existing wall 14. Thereafter, plugs 52 are removed, since they are no longer necessary.

Then, moving down in FIG. 1 to position B, a second wall panel 12 which has been previously assembled with a corner fastening extrusion 76 at left side bent end section 18*b* and with main fastening extrusions 28 at right side bent end section 18*c* and bottom bent end section 18*d*, is assembled in the same manner. No main fastening extrusion 76 is assembled with top bent end section 18*a*. Rather, top bent end section 18*a* at position B is inserted in the gap of the main fastening extrusion 28 secured with bottom bent end section 18*d* of wall panel 12 at position A. Thus, top bent end section 18*a* of the wall panel at position B is inserted into this other main fastening extrusion 28 such that cut-out recess 24 of this top bent end section 18*a* at position B receives the projection 44 of the other bent end securing wall 38 of the main fastening extrusion 28 already assembled with the wall panel 12 at position A. In this manner, the wall panel 12 at position B merely hangs down from this main fastening extrusion 28 already screwed into the wall.

In this position, screws (not shown) are inserted through openings 100 of corner fastening extrusion 76 at position B, and through openings 36 in wing sections 43 of main fastening extrusions 28 pre-assembled with left side bent end section 18*c* and bottom bent end section 18*d* at position B so as to secure wall panel 12 at position B.

This operation continues for wall panels at positions C and D in FIG. 1, with the only exception being that a corner fastening extrusion 76 is assembled with bottom bent end section 18*d* of the wall panel 12 at position D.

Thereafter, the assembling operation can proceed to position E in FIG. 1. For this position, a corner fastening extrusion 76 is first assembled with wall panel 12 at top bent end section 18*a*, and main fastening extrusions 18*c* and 18*d* are assembled with the same wall panel at right end bent end section 18*c* and bottom bent end section 18*d*. With this pre-assembly, left side bent end section 18*b* is assembled with the other bent end securing wall 38 of the main fastening extrusion 28 assembled with right side bent end section 18*c* at position A such that cut-out recess 24 of this left side bent end section 18*b* at position E is assembled with the projection 44 at the other bent end securing wall 38 of the main fastening extrusion 28 assembled with right side bent end section 18*c* at position A. Screws (not shown) are then inserted into openings 100 of corner fastening extrusion 76 assembled with wall panel 12 at top bent end section 18*a*, and into openings 36 of main fastening extrusions 18*c* and 18*d* assembled with the same wall panel at right end bent end section 18*c* and bottom bent end section 18*d*, in order to secure the wall panel 12 at position E. Plugs 52 can then be removed.

At position F in FIG. 1, main fastening extrusions 28 are only pre-assembled with bent end sections 18*c* and 18*d*. In such case, the left bent end section 18*b* is assembled with the main fastening extrusion 28 already assembled with the right side bend end section 18*c* at position B, and the top bent end section 18*a* is assembled with the main fastening extrusion 28 already assembled with the bottom side bend end section 18*d* at position E. Thereafter, the main fastening extrusions 28 pre-assembled with right side bent end section 18*c* and bottom bent end section 18*d* at position F are screwed into the wall through openings 36.

This operation continues for wall panels at positions G and H in FIG. 1, with the only exception being that a corner fastening extrusion 76 is assembled with bottom bent end section 18*d* of the wall panel 12 at position H. The operation of wall panels at positions E-H continues in the direction to the right in FIG. 1 until the last panel positions I-L are reached.

Figure 6:
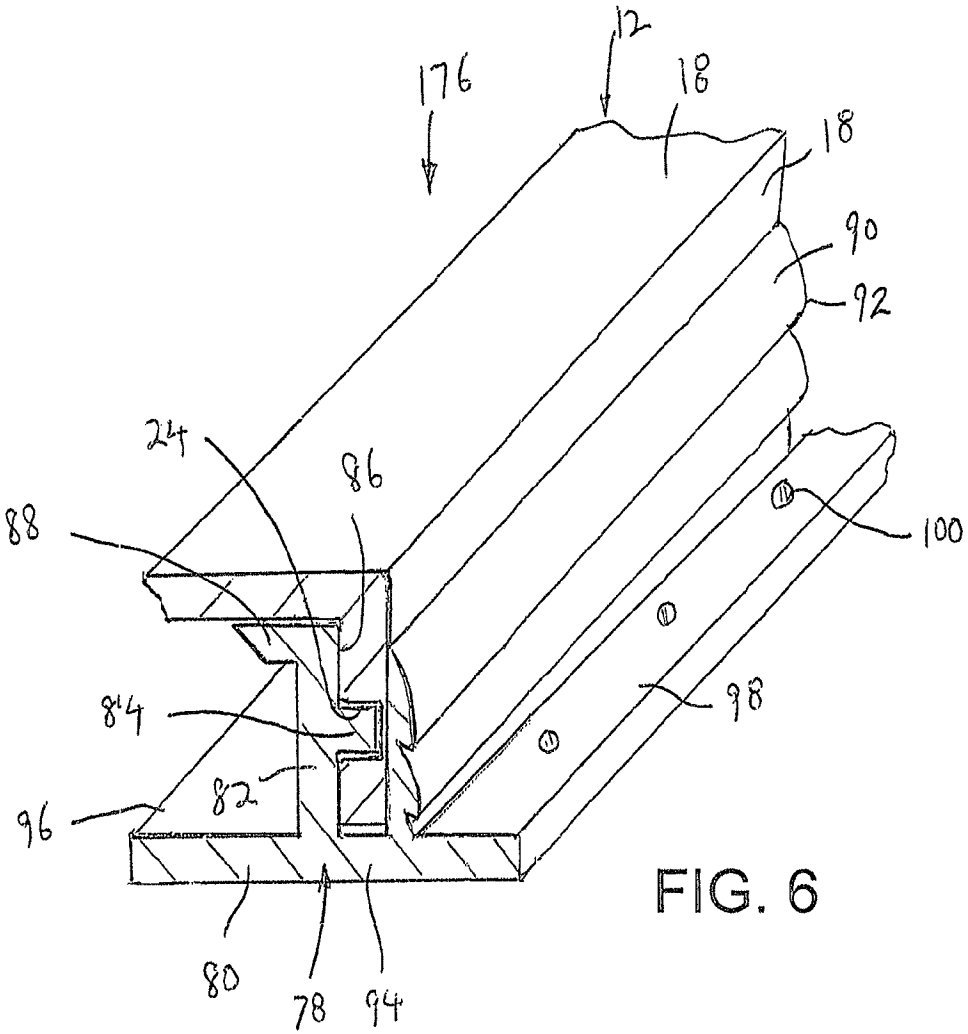
FIG. 6 is a perspective view, partly in section, of a second corner fastening extrusion having a wall panel secured thereto, according to the present invention.

At positions I-L in FIG. 1, the same operation occurs as with wall panels 12 at position E-H, except that a right side corner fastening extrusion 176 (FIG. 6) is assembled with right side bent end section 18*c* of the wall panel 12 at these positions, in which right side corner fastening extrusion 176 is a mirror image of left side corner fastening extrusion 76.

Figure 7:
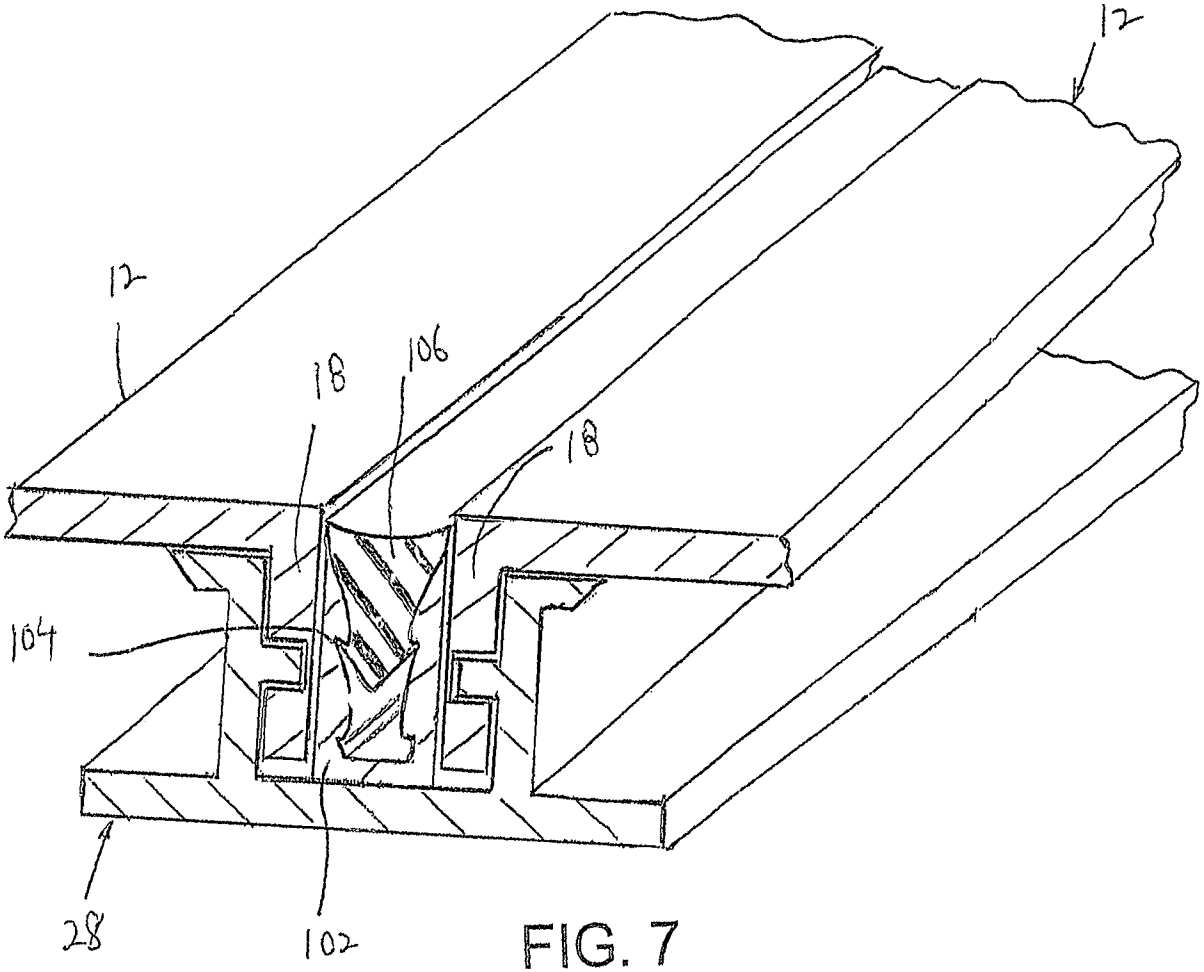
FIG. 7 is a perspective view, partly in section, of the main fastening extrusion of FIG. 2 connected with two wall panels, and with a channel and plug between the wall panels.

When plugs 52 are removed and walls panels 12 are installed, it is preferable to fill the gaps between bent end sections 18 of adjacent wall panels 12, that is, in the space previously occupied by plugs 52. In this regard, as shown in FIG. 7, an elongated U-shaped channel 102 is inserted in the gap between adjacent bent end sections of adjacent wall panels 12. Preferably, the inner facing surfaces of U-shaped channel 102 has barbs 104 for capturing a rubber or plastic plug 106 inserted therein to provide an aesthetic appearance.

Figure 8:
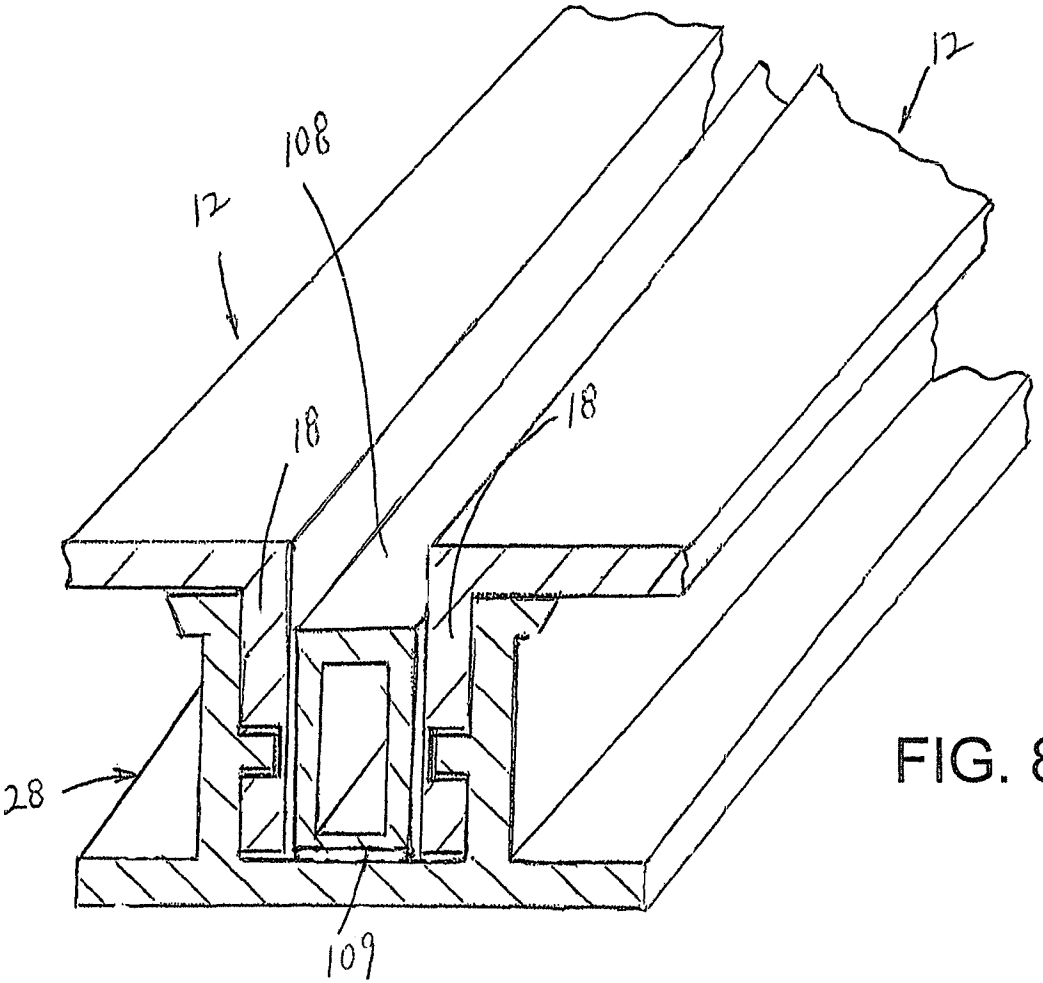
FIG. 8 is a perspective view, partly in section, of the main fastening extrusion of FIG. 2 connected with two wall panels, and with an elongated member between the wall panels.

Alternatively, as shown in FIG. 8, at least one elongated plug member 108 having a rectangular cross-section can be inserted into this gap to provide an aesthetic appearance, and secured therein by structural caulking or tape 109, which can be a double side adhesive tape sold by The 3M Company.

Figure 8A:
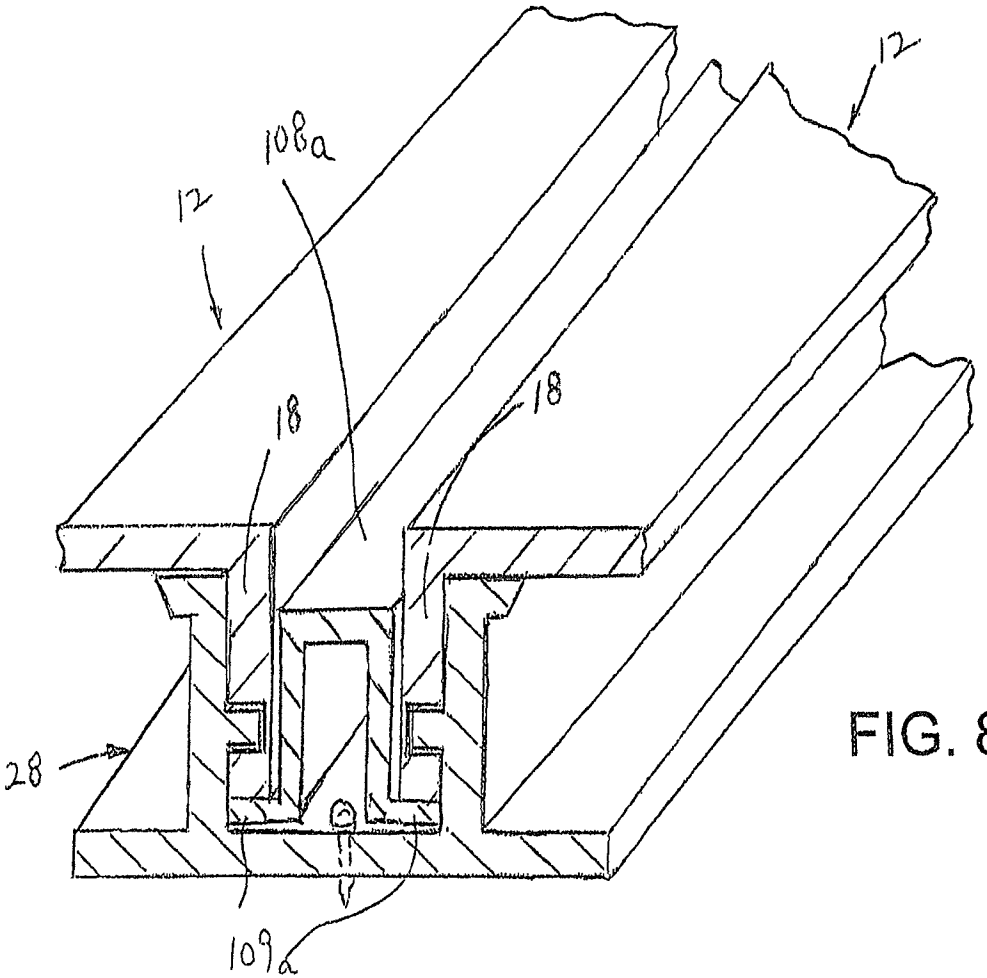
FIG. 8A is a perspective view, partly in section, of a the main fastening extrusion of FIG. 8 connected with two wall panels, and with a modified elongated member between the wall panels.

Referring to FIG. 8A, there is shown a modification of the FIG. 8 embodiment in which elongated plug member 108 is replaced by an elongated, inverted U-shaped plug member 108*a*, that is, basically, the same as elongated member 108 having its lower wall removed. In addition, there are lower outwardly extending wings 109*a* extending outwardly from the lower edges of inverted U-shaped member 108*a*, which extend beneath the distal lower ends of bent end sections 18. Inverted U-shaped member 108*a* can be slid in from the side after bent end sections 18 are assembled in position. Bent end sections 18 can be placed in the position shown in FIG. 8 by merely inserting them in the gap between the bent end securing walls, or alternatively, can be slid in from the side.

Figure 8B:
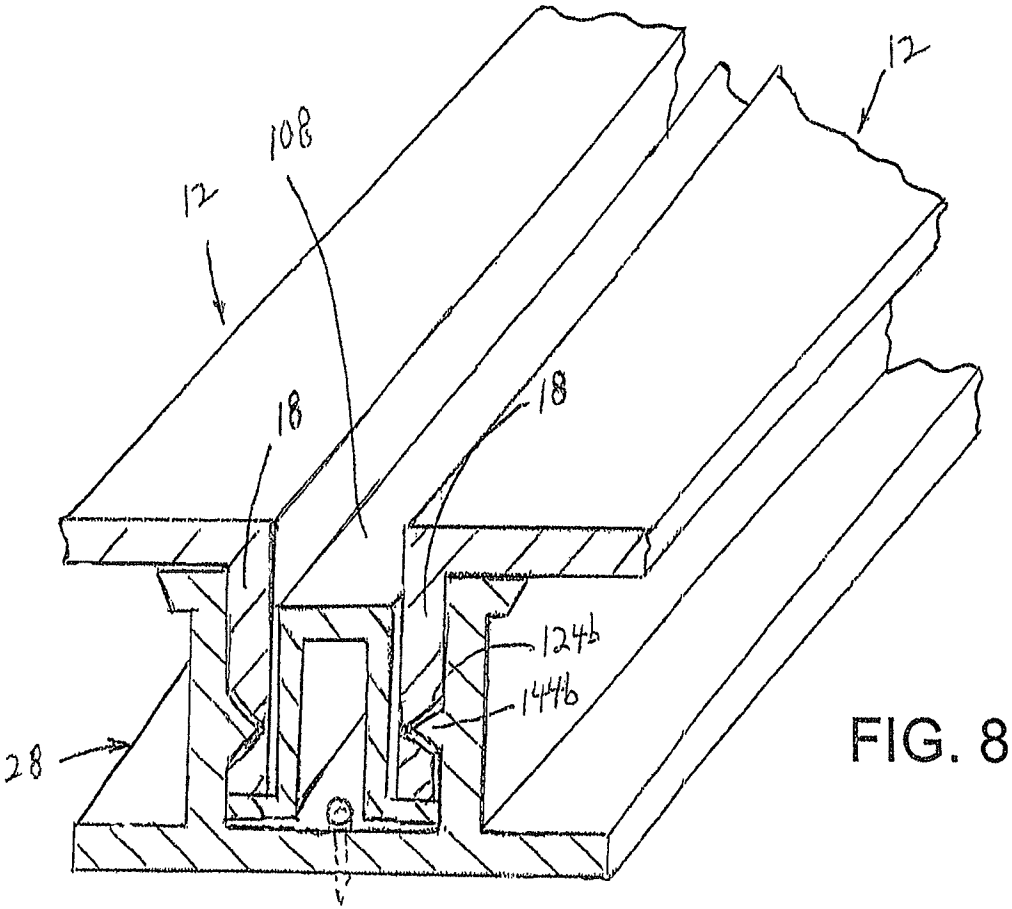
FIG. 8B is a perspective view, partly in section, of a modification of the main fastening extrusion of FIG. 8A connected with two wall panels.

FIG. 8B shows a modification of the FIG. 8A embodiment in which the cut-out recess 124*b* and inwardly directed projection 144*b* each have complementary triangular shapes in cross-section.

Figure 9:
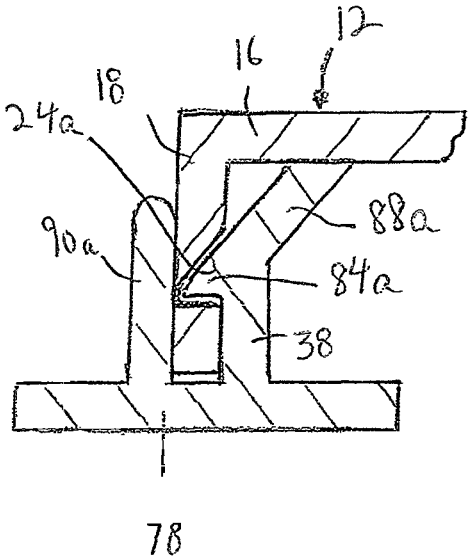
FIG. 9 is a cross-sectional view of a first modified corner fastening extrusion according to the present invention.

As discussed above, inwardly directed projection 44 at the inner surface 46 of the respective bent end securing wall 38 corresponds in shape and dimensions to square or rectangular cut-out recess 24, although the present invention is not limited thereby. For example, each cut-out-section 32 and projection 44 can have a nose-shape in cross-section as shown in applicant's copending U.S. patent application Ser. No. 13/868,574, the entire disclosure of which is incorporated herein by reference, or any other suitable configuration. The same applies to projection 84 of each corner fastening extrusion 76, 176, for example, as shown in FIG. 9, in which each projection 84*a* and cut-out recess 24*a* has a nose-shaped cross-section. As also shown, barbs 92 are eliminated from second wall 90*a*. Further, because of the nose-shaped cross-section of projection 84, outwardly extending stub wall 88 is replaced by an inclined wall 88*a* that extends from projection 84*a* with the free end thereof immediately adjacent to or abutting with main panel section 16 when assembled with wall panel 12.

Figure 10:
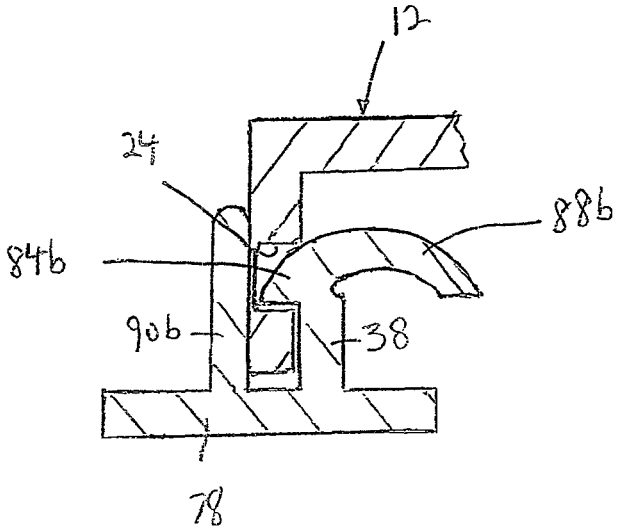
FIG. 10 is a cross-sectional view of a second modified corner fastening extrusion according to the present invention.

As another alternative, as shown in FIG. 10, projection 84*b* has a triangular nose-shaped configuration in cross-section with a rounded upper surface that engages in cut-out recess 24 of a square or rectangular cross-section. In this case, outwardly extending stub wall 88 is replaced by an arcuate wall 88*b* that extends from projection 84*b*. As also shown, barbs 92 are eliminated from second wall 90*b*.

Figure 11:
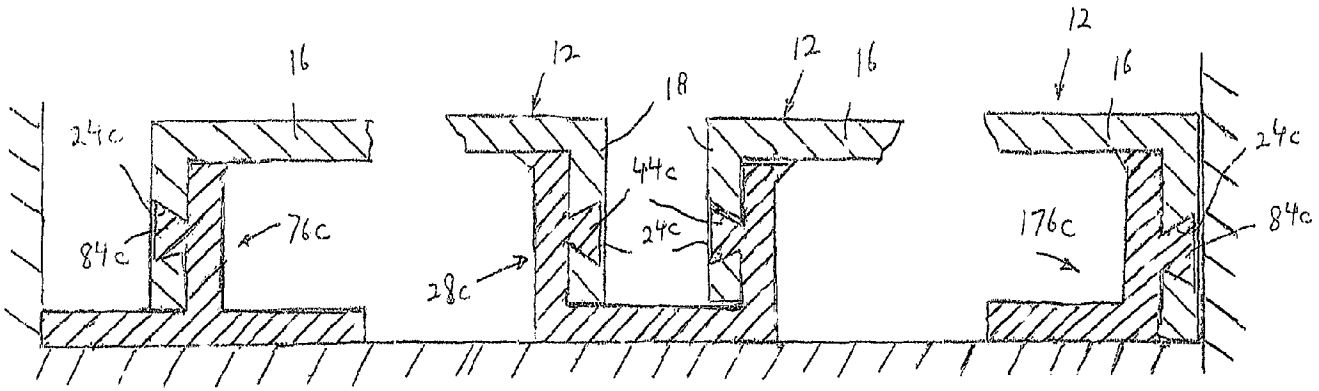
FIG. 11 is a cross-sectional view of a further modified main fastening extrusion and corner fastening extrusions according to the present invention.

As another alternative, as shown in FIG. 11, the projections 44, 84 of square or rectangular cross-section and cut-out recesses 24, are replaced with a dovetail joint, that is, with projections 44*c*, 84*c* being of a trapezoidal cross-section and cut-out recesses 24*c* being of a complementary trapezoidal cross-section. In this case, for corner fastening extrusions 76*c*, 176*c*, the second bent end securing wall is eliminated. However, to assemble wall panels 12 with main fastening extrusions 28*c* and corner fastening extrusions 76*c*, 176*c*, it is necessary to slide projections 44*c*, 84*c* lengthwise into cut-out recesses 24*c* prior to bending bent end sections 18 at right angles to main panel sections 16.

Figure 12:
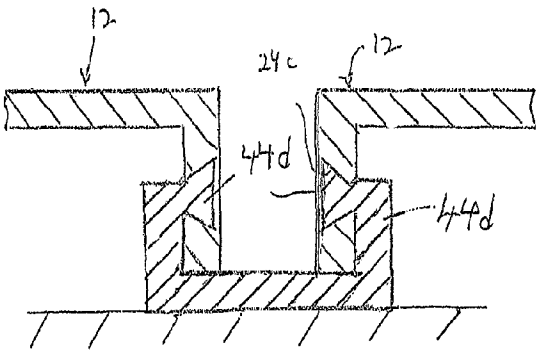
FIG. 12 is a cross-sectional view of a still further modified main fastening extrusion according to the present invention.

FIG. 12 shows a slight modification to the embodiment of FIG. 11, whereby bent end securing walls 38 terminate at projections 44*d* of main fastening extrusion 44*d* and thereby are not positioned adjacent main panel section 16 when assembled therewith.

Figure 12A:
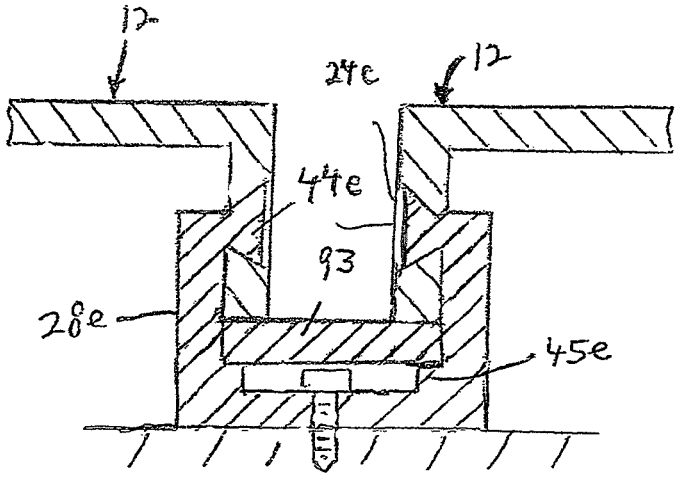
FIG. 12A is a cross-sectional view of a modified main fastening extrusion of FIG. 12.

FIG. 12A shows a slight modification to the embodiment of FIG. 12, whereby an extra gap is provided between outer steps 45*e* of main fastening extrusion 28*e* and the distal lower ends of bent end sections 18 in order to slide a rectangular parallelepiped member 93 in the gap for closing off the gap and providing an aesthetic appearance. Rectangular parallelepiped member 93 also covers any screws used to secure main fastening extrusion 28*e*. In this embodiment, trapezoidal projections 44*e* in cross-section are also formed.

Figure 12B:
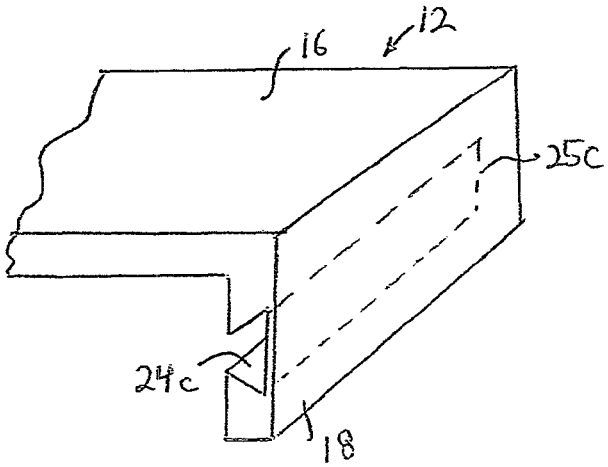
FIG. 12B is a perspective view of a further modified main fastening extrusion of FIG. 12.

FIG. 12B shows a slight modification to the embodiment of FIG. 12, whereby ends of each cut-out recess 24*c* are open at one end but closed at an opposite end 25*c*, which permits projections 44*c* to slide therein but not to fall out the other end. This is particularly advantageous if cut-out recesses 24*c* are oriented vertically.

Figure 13:
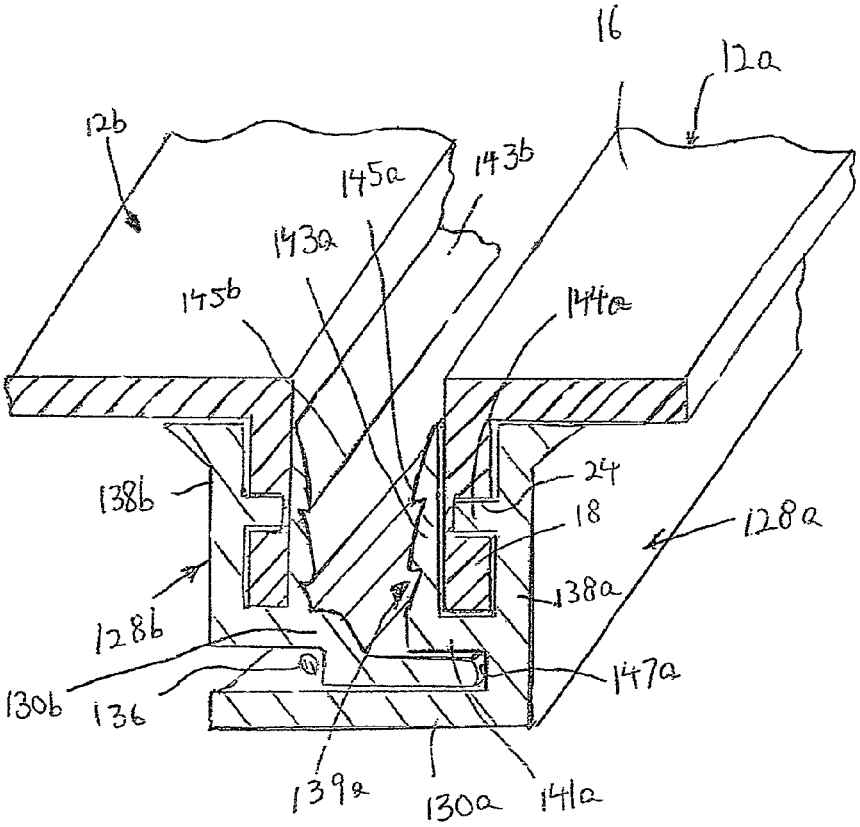
FIG. 13 is a cross-sectional view of a yet further modified main fastening extrusion according to the present invention.
Figure 14:
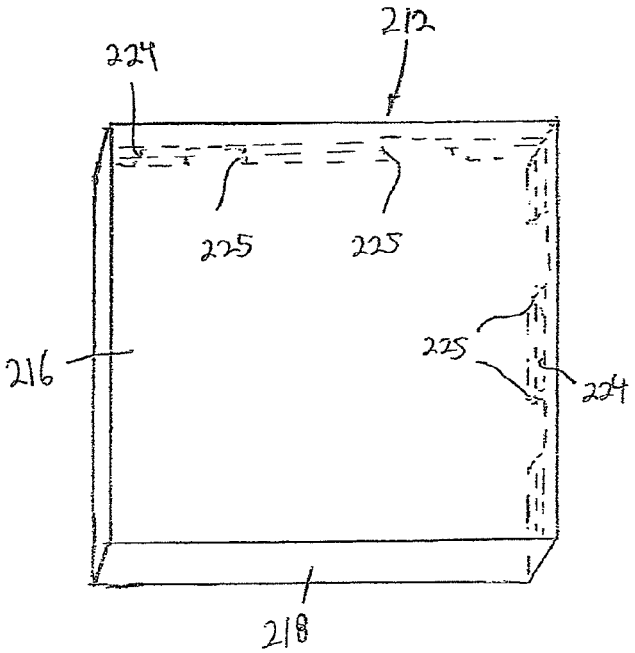
FIG. 14 is a perspective view of a wall panel according to another embodiment of the present invention.
Figure 15:
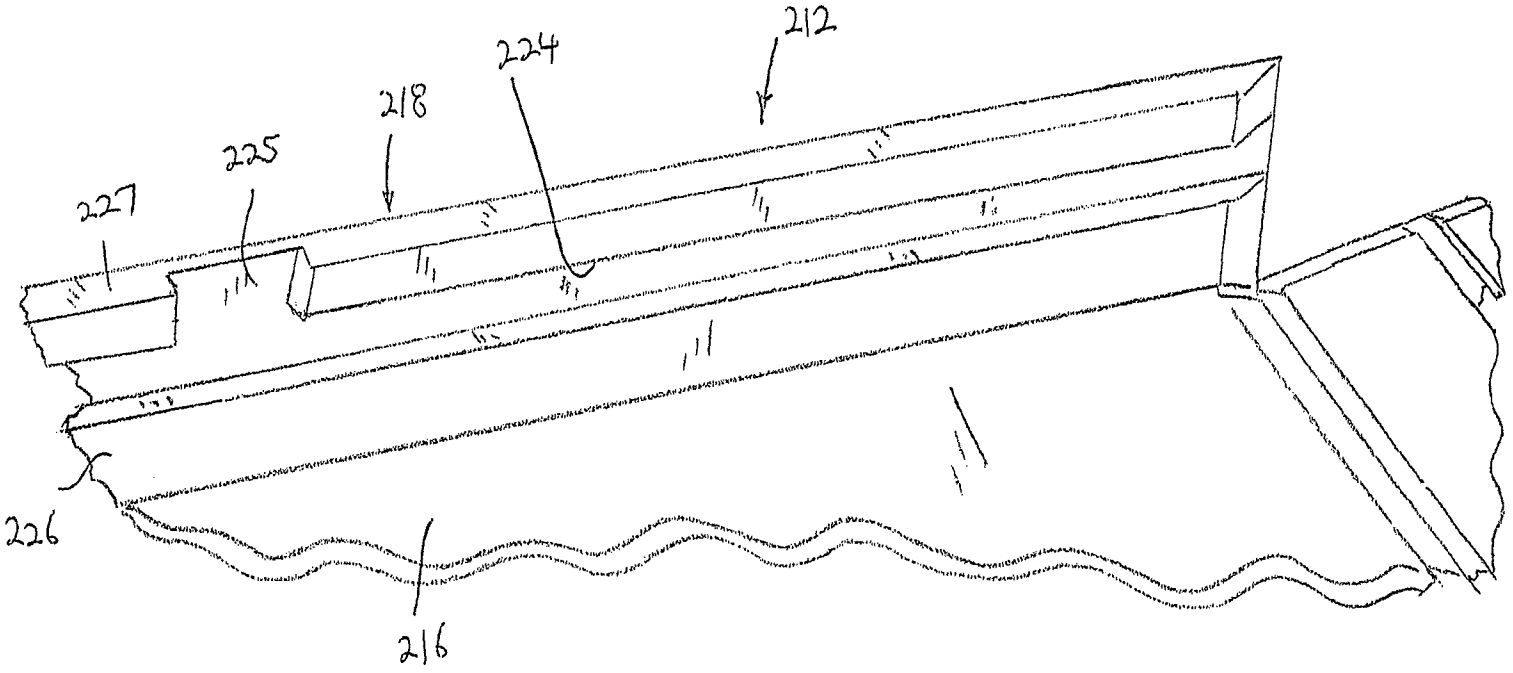
FIG. 15 is a bottom perspective view of a portion of the wall panel of FIG. 14, with only one bent end section bent at a right angle to the main panel section thereof.
Figure 16:
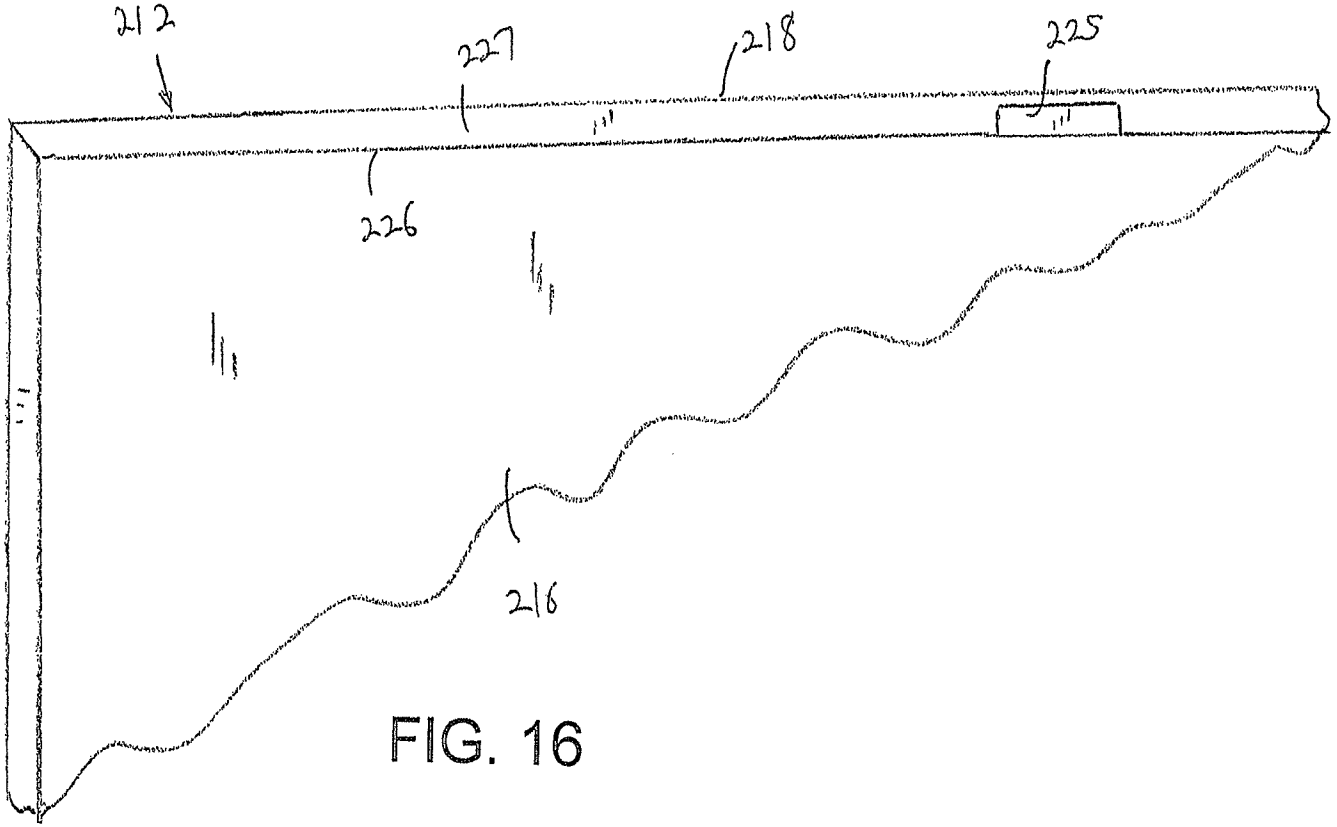
FIG. 16 is a bottom plan view of a portion of the wall panel of FIG. 14.
Figure 21:
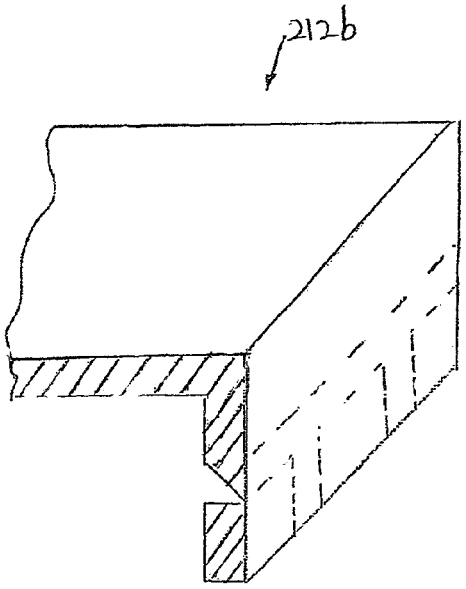
FIG. 21 is a perspective view, partly in section, of a further modification of the wall panel of FIG. 14.
Figure 22:
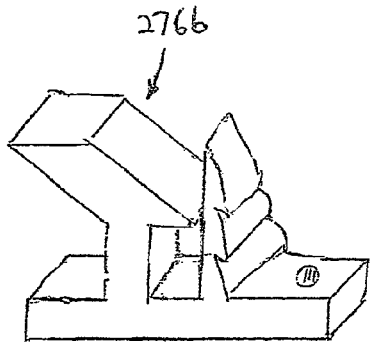
FIG. 22 is a perspective view of a further modified fastening extrusion segment for use with the wall panel of FIG. 21.
Figure 23:
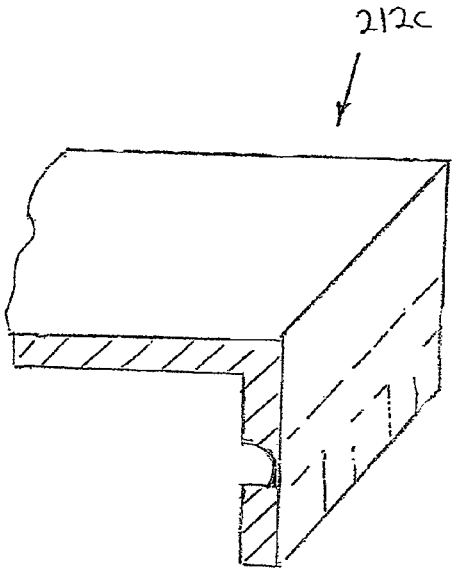
FIG. 23 is a perspective view, partly in section, of a still further modification of the wall panel of FIG. 14.
Figure 24:
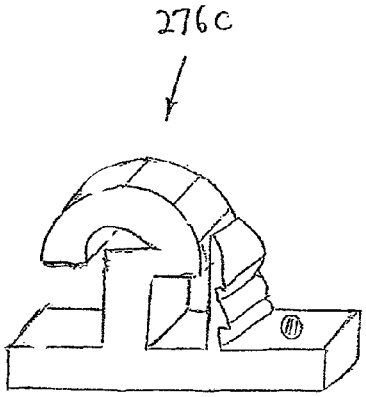
FIG. 24 is a perspective view of a still further modified fastening extrusion segment for use with the wall panel of FIG. 23.

FIG. 13 shows a further modification of a main fastening extrusion 128 which is comprised of two extrusion parts 128*a* and 128*b* assembled together. One extrusion part 128*a* includes a base wall 130*a* and a bent end securing wall 138*a* extending upwardly from one edge thereof, with a projection 144*a* at an inner surface of bent end securing wall 138*a*. An upwardly extending L-shaped extension 139*a* includes a first leg 141*a* as a lateral connecting wall that extends inwardly from a lower portion of bent end securing wall 138*a* at a position spaced above and parallel to base wall 130*a*, and a second leg 143*a* as an inner wall that extends upwardly from the free end of first leg 141*a* and in parallel spaced apart relation to the respective securing wall 138*a* with a spacing substantially equal to the thickness of a bent end section 18 which fits therein. The outer surface of second wall 143*a* includes downwardly extending barbs 145*a*. In this manner, bent end sections 18 are slidably inserted in the gap between a bent end securing wall 138*a* and the respective second leg 143*a*, and then bent at right angles to main panel section 16.

With this arrangement, there is a space 147*a* between base wall 130*a* and first leg 141*a*. Further, base section 130*a* includes openings 136 for securing base wall 130*a* to a wall 14.

The other extrusion part 128*b* includes a base section 130*b* and a bent end securing wall 138*b* extending upwardly from one edge thereof. An upwardly extending second leg 143*b* as an inner wall extends upwardly from base section 130*b* in parallel spaced apart relation to the respective securing wall 138*b* with a spacing substantially equal to the thickness of a bent end section 18 which fits therein. The outer surface of second wall 143*b* includes downwardly extending barbs 145*b*. In this manner, bent end sections 18 are slidably inserted in the gap between a bent end securing wall 138*b* and the respective second leg 143*b*, and then bent at right angles to main panel section 16.

During assembly, extrusion part 128*a* with a wall panel 12*a* secured thereto is secured to a wall 14 with screws (not shown) extending through openings 136. Then, extrusion part 128*b* having a wall panel 12*b* secured thereto has its base section 130*b* inserted into space 147*a*, and screws (not shown) are inserted into openings 136 in a different extrusion part 128*a* at the opposite side of wall panel 12*b*. As a result, the panels 12*a* and 12*b* are secured relative to each other, with the barbs 145*a* and 145*b* facing each other in order to receive a plug for aesthetic appearances.

With all of the above embodiments, except for FIGS. 2, 2A, 7 and 8, the bent end sections must be slid in from the side.

Referring now to FIGS. 14-17, there is shown a system according to another embodiment of the present invention for easily mounting wall panels 212 over an existing wall structure. The wall structure preferably includes any planar wall. Each wall panel 212 includes a rectangular shaped, planar main panel section 216 and at least two bent end sections 218 bent at a right angle in the same direction at edges of main panel section 216. Main panel 216, however, need not be planar, and in fact, can have different shapes, such as a wave shape, etc. to provide different aesthetic appearances. Preferably, there are four bent end sections 218 at each edge of main panel section 216 which form an L-shaped cross-sectional shape thereat. However, the invention is not limited thereby and wall panels 212 can be formed with two, three or four bent end sections 218. Wall panels 212 are formed preferably by, but not limited to, a polyethylene core 20 with a thin aluminum wall 22 covering opposite sides thereof, as shown in FIG. 4. However, for the sake of simplicity in the drawings, all of the drawings except for FIG. 4 show wall panels 212 formed of only a single material.

In addition, each bent end section 218 includes a first cut-out recess 224 at the inner surface 226 thereof and spaced slightly away from main panel section 216. Each cut-out recess 224 preferably has a square or rectangular configuration in cross-section, although the present invention is not limited thereby. As a result, cut-out recess 224 effectively forms a notch in the inner surface 226 of bent end section 218. Cut-out recess 224 preferably extends along the entire length of the bent end section 218, although the present invention is not so limited, that is, cut-out recess 224 can extend along only a part of the length of bent end section 218, or there may be a plurality of spaced apart cut-out recesses 224.

In addition, the inner surfaces 226 of bent end sections 218 further include at least one, and preferably, plurality of, second cut-out recesses 225, each of which forms a notch in the inner surface 226 of bent end section 218. Each cut-out recess 225 extends in a direction perpendicular to the lengthwise direction of the bent end section 218, starting from the free distal end 227 of the bent end section and extending in a direction toward main panel section 216, terminating at first cut-out recess 224 and in open communication therewith.

With this embodiment, rather than providing a main fastening extrusion 28 or corner fastening extrusion 76 that extends the entire length of a bent end section 18, a plurality of fastening extrusion segments 276 (FIG. 18) which are identical in construction to corner fastening extrusions 76 are provided, but which extend for only a fraction of the length of corner fastening extrusions 76.

Thus, each fastening extrusion segment 276 includes a base section 278 formed by a planar wall 280 that is adapted to lie flush against an existing wall 14. A first bent end securing wall 282 extends outwardly at a right angle from planar wall 280 for securing a bent end section 218 of a wall panel 212 thereto. Bent end securing wall 282 includes a projection 284 at the inner surface 286 thereof, with projection 284 having a parallelepiped configuration, which corresponds in shape and dimensions to square or rectangular cut-out recess 224, although the present invention is not limited thereby and can have any other suitable configuration. Projection 284 extends entirely across the bent end securing wall 282.

The upper free end of bent end securing wall 282 includes an outwardly extending stub wall 288 that is perpendicular to the respective bent end securing wall 282 and parallel to and immediately adjacent to or abutting with main panel section 216 when assembled with wall panel 212.

A bent end securing wall 290 extends outwardly from planar wall 280 in parallel, spaced apart relation to first bent end securing wall 282, with the spacing between bent end securing walls 282 and 290 being substantially equal to the thickness of one bent end section 218. Projection 284 faces in a direction toward bent end securing wall 290 as to be positioned in the gap between bent end securing walls 282 and 290. The opposite side of second wall 290 is provided with barbs 292 that are angled toward planar wall 280. Planar wall 280 is thereby divided into a central section 294 between bent end securing walls 282 and 290, and two wing sections 296 and 298 to the outside of bent end securing wall 282 and second wall 290, respectively, with wing section 298 having an opening 300 extending therealong and through which a screw (not shown) can be inserted to secure planar wall 280 to existing wall structure 14.

With this embodiment, each fastening extrusion segment 276 is connected with a bent end section 218 by passing projection 284 up through a second cut-out recess 225 until the projection 284 reaches first cut-out recess 224, where it can then be slid along first cut-out recess 224 to removably hold the fastening extrusion segment 276 to the respective bent end section 218. The fastening extrusion segment 276 can be secured to an existing wall structure by screws (not shown) extending through opening 300 therein. In this way, wall panels 212 can be secured to an existing wall structure in the same way as described with the first embodiment. In other words, fastening extrusion segments 276 can be pre-assembled with wall panels 212 and then brought to a job site, saving time and energy, and enabling easier mounting of wall panels 212.

FIGS. 19 and 20 show a fastening extrusion segment 276*a* which differs from fastening extrusion segment 276 of FIG. 18 by modifying parallelepiped projection 284 to form fastening extrusion segment 276*a* with a projection 284*a* having a cylindrical configuration at the same height, and with bent end securing wall 282*a* terminating at cylindrical projection 284*a*. In such case, cut-out recess 224*a* of bent end section 218*a* of wall panel 212*a* has a semi-circular configuration in cross-section to correspond thereto. In such case, second cut-out recesses 225 would remain the same.

Other configurations can be provided as well, such as fastening extrusion segments 276*b* and 276*c* and the corresponding wall panels 212*b* and 212*c* shown in FIGS. 21-24, and which correspond essentially to fractions of the same shown in FIGS. 9 and 10, but with the addition of barbs.

It will therefore be appreciated that, by using the present invention, the fastening extrusions can be assembled with the wall panels at a shop, prior to bringing the same to a job site, thereby saving time and energy.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A system for mounting wall panels to an existing wall structure, comprising:

a plurality of wall panels, each wall panel including:

a main wall panel section, and at least two bent end sections extending at an angle from different edges of said main wall panel section, each bent end section having a wall thickness;

a plurality of main fastening extrusions, each main fastening extrusion including:

a base section adapted to be secured to the existing wall structure, and first and second spaced apart bent end securing walls extending at an angle from said base section, the two bent end securing walls having a spacing therebetween greater than the wall thickness of two said bent end sections, one of:

a recess at a first surface of each bent end section which faces a second surface of a respective said bent end securing wall, and a projection at the second surface of each bent end securing wall which is adapted to be received in a respective said recess; and a recess at the second surface of each bent end securing wall, and a projection at the first surface of each bent end section which is adapted to be received in a respective said recess at the second surface;

a plug member inserted in the spacing between adjacent bent end securing walls for preventing escape of the adjacent bent end securing walls from the spacing, the plug member held in the spacing by at least one of the following:

a tape at a lower end of the plug member that secures the plug member to the base section, and at least one wing extending outwardly from a lower end of the plug member and which extends beneath a distal lower end of a respective bent end section.

2. A system according to claim 1, wherein each projection has a cross-sectional shape selected from the following shapes:

a square shape, a rectangular shape, a triangular shape, a triangular shape with a rounded upper surface, a trapezoidal shape, and a cylindrical shape.

3. A system according to claim 1, wherein each recess is formed in the first surface of each bent end section, and each projection is formed at the second surface of each bent end securing wall.

4. A system according to claim 1, wherein the plug member includes two wings extending outwardly in opposite directions from a lower end of the plug member and which extend beneath a distal lower end of respective said adjacent bent end sections in the spacing.

5. A system for mounting wall panels to an existing wall structure, comprising:

a plurality of wall panels, each wall panel including:

a main wall panel section, and at least two bent end sections extending at an angle from different edges of said main wall panel section, each bent end section having a wall thickness;

a plurality of main fastening extrusions, each main fastening extrusion including:

a base section adapted to be secured to the existing wall structure, and first and second spaced apart bent end securing walls extending at an angle from said base section, the two bent end securing walls having a spacing therebetween greater than the wall thickness of two said bent end sections, one of:

a recess at a first surface of each bent end section which faces a second surface of a respective said bent end securing wall, and a projection at the second surface of each bent end securing wall which is adapted to be received in a respective said recess; and a recess at the second surface of each bent end securing wall, and a projection at the first surface of each bent end section which is adapted to be received in a respective said recess at the second surface;

each recess and projection form a dovetail joint, with each projection engaged in a respective said recess by sliding transversely therein.

6. A system according to claim 5, wherein each recess is formed in the first surface of each bent end section, and each projection is formed at the second surface of each bent end securing wall.

7. A system according to claim 5, wherein each projection and each recess has a trapezoidal cross-sectional shape.

8. A system according to claim 5, wherein an extra gap is provided between the base section of each main fastening extrusion and distal lower ends of bent end sections, and a plate member is provided in the gap for closing off the gap and providing an aesthetic appearance.

9. A system for mounting wall panels to an existing wall structure, comprising:

a plurality of wall panels, each wall panel including:

a main wall panel section, and at least two bent end sections extending at an angle from different edges of said main wall panel section, each bent end section having a wall thickness;

a plurality of main fastening extrusions, each main fastening extrusion including:

a base section adapted to be secured to the existing wall structure, and first and second spaced apart bent end securing walls extending at an angle from said base section, the two bent end securing walls having a spacing therebetween substantially equal to the wall thickness of one said bent end section, one of:

a recess at a first surface of each bent end section which faces a second surface of the first bent end securing wall, and a projection at the second surface of each first bent end securing wall which is adapted to be received in the recess at the first surface of the respective bent end section; and a recess at the second surface of each bent end securing wall, and a projection at the first surface of each bent end section which is adapted to be received in a respective said recess at the second surface; and each projection has an upper surface with a shape of one of the following:

an inclined surface, and a curved convex surface.

10. A system according to claim 9, wherein each recess has a shape one of:

corresponding to the shape of the respective projection received therein, and a rectangular cross-sectional shape.

11. A system for mounting wall panels to an existing wall structure, comprising:

a plurality of wall panels, each wall panel including:

a main wall panel section, and at least two bent end sections extending at an angle from different edges of said main wall panel section, each bent end section having a wall thickness;

a plurality of main fastening extrusions, each main fastening extrusion including:

a first main fastening extrusion section including:

a first base section adapted to be secured to the existing wall structure, a first bent end securing wall extending at an angle from said first base section, and an L-shaped extension including:

a first leg as a lateral connecting wall that extends inwardly from a lower portion of the first bent end securing wall at a position spaced above and parallel to the first base wall so as to form a space therebetween, and a second leg as a first inner wall that extends from a free end of first leg in parallel spaced apart relation to the first bent end securing wall with a spacing substantially equal to the wall thickness of one said bent end section which fits therein;

a second main fastening extrusion section including:

a second base section adapted to be positioned within the space between the first leg and the first base wall, a second bent end securing wall extending at an angle from said second base section, and a second inner wall that extends from the second base section in parallel spaced apart relation to the second bent end securing wall with a spacing substantially equal to the wall thickness of one said bent end section which fits therein; and one of:

a recess at a first surface of each bent end section which faces a second surface of the respective bent end securing wall, and a projection at the second surface of each said bent end securing wall which is adapted to be received in the recess at the first surface of the respective bent end section; and a recess at the second surface of each bent end securing wall, and a projection at the first surface of each bent end section which is adapted to be received in a respective said recess at the second surface.

12. A system according to claim 11, wherein there is a spacing between the first and second inner walls, and surfaces of the first and second inner walls that face each other have barbs thereon for receiving a plug.

* * * * *